US007775895B2

(12) United States Patent
Henry et al.

(10) Patent No.: US 7,775,895 B2
(45) Date of Patent: Aug. 17, 2010

(54) WATER AMUSEMENT PARK WATER CHANNEL AND ADJUSTABLE FLOW CONTROLLER

(75) Inventors: Jeffery Wayne Henry, New Braunfels, TX (US); John Timothy Schooley, Houston, TX (US)

(73) Assignee: Water Ride Concepts, Inc., New Braunfels, TX (US)

( * ) Notice: Subject to any disclaimer, the term of this patent is extended or adjusted under 35 U.S.C. 154(b) by 531 days.

(21) Appl. No.: 11/244,872

(22) Filed: Oct. 6, 2005

(65) Prior Publication Data

US 2007/0049388 A1 Mar. 1, 2007

Related U.S. Application Data

(60) Provisional application No. 60/705,298, filed on Aug. 3, 2005, provisional application No. 60/717,568, filed on Sep. 15, 2005.

(51) Int. Cl.
*A63G 31/10* (2006.01)
*A63G 31/00* (2006.01)

(52) U.S. Cl. ..... 472/128; 472/117

(58) Field of Classification Search ..... 472/116, 472/117, 128, 129, 13; 405/84–86, 79, 80; 104/53, 69, 70

See application file for complete search history.

(56) References Cited

U.S. PATENT DOCUMENTS 193,516 A * 7/1877 Johns ..... 405/84
419,860 A 1/1890 Libbey
435,227 A 8/1890 Inglis
485,624 A 11/1892 Gardner
536,441 A 3/1895 Morris
540,715 A 6/1895 Butler
548,256 A 10/1895 Idler
552,713 A 1/1896 Lenox (Continued)

FOREIGN PATENT DOCUMENTS

BE 543055 12/1955

(Continued)

OTHER PUBLICATIONS

International Search Report for PCT/US01/28535 mailed Mar. 27, 2002.

(Continued)

*Primary Examiner*—Kien T Nguyen
(74) *Attorney, Agent, or Firm*—Meyertons, Hood, Kivlin, Kowert & Goetzel, P.C.; Eric B. Meyertons

(57) ABSTRACT

A water amusement ride system is disclosed. The system may include a first channel of water. The first channel may function to convey participants in a first direction. The system may include a second channel of water. The second channel may function to convey participants in a second direction. The second direction may be different from the first direction. The system may include a first adjustable flow controller positioned in the first channel of water. The system may include a third channel coupling the first channel, upstream of the first adjustable flow controller, to the second channel. The first adjustable flow controller may function at least in part to control the flow of water through the third channel. The system may be part of a continuous water ride.

23 Claims, 20 Drawing Sheets

U.S. PATENT DOCUMENTS

| | | | | |
|---|---|---|---|---|
| 555,049 | A | | 2/1896 | Ogilbe |
| 566,182 | A | | 8/1896 | Jackman |
| 570,016 | A | | 10/1896 | Harman |
| 572,426 | A | | 12/1896 | Idler |
| 576,704 | A | | 2/1897 | Urch |
| 583,121 | A | | 5/1897 | Pattee |
| 604,164 | A | | 5/1898 | Wilde et al. |
| 610,548 | A | * | 9/1898 | Manny ..... 405/85 |
| 640,439 | A | | 1/1900 | Boyton |
| 654,980 | A | | 7/1900 | Howard |
| 664,179 | A | | 12/1900 | Schofield |
| 665,765 | A | | 1/1901 | Thompson |
| 689,114 | A | | 12/1901 | Pape |
| 691,353 | A | | 1/1902 | Carpenter et al. |
| 697,202 | A | | 4/1902 | Donne |
| 697,891 | A | | 4/1902 | Schrader |
| 714,717 | A | | 12/1902 | LaPorte |
| 720,014 | A | | 2/1903 | Folks |
| 724,040 | A | | 3/1903 | Pusterla |
| 724,757 | A | | 4/1903 | Symonds |
| 728,303 | A | | 5/1903 | Roltair |
| 728,894 | A | | 5/1903 | Folks |
| 741,964 | A | | 10/1903 | Harlan |
| 743,968 | A | | 11/1903 | Wilson |
| 744,880 | A | | 11/1903 | Smith |
| 753,311 | A | | 3/1904 | Pusterla |
| 753,449 | A | | 3/1904 | Thompson |
| 754,698 | A | | 3/1904 | Reed |
| 757,286 | A | | 4/1904 | Du Clos |
| 760,503 | A | | 5/1904 | Welsh |
| 762,566 | A | | 6/1904 | Webster et al. |
| 764,675 | A | | 7/1904 | Pfeiffer |
| 774,209 | A | | 11/1904 | Stubbs |
| 774,274 | A | | 11/1904 | Pusterla |
| 774,917 | A | | 11/1904 | Maguire |
| 776,936 | A | | 12/1904 | Pusterla |
| 779,464 | A | | 1/1905 | Bruce |
| 783,425 | A | | 2/1905 | Folks |
| 792,422 | A | | 6/1905 | Kelly |
| 801,945 | A | | 10/1905 | Welsh |
| 808,487 | A | | 12/1905 | Stahl |
| 824,436 | A | | 6/1906 | Pester |
| 828,689 | A | | 8/1906 | Thompson |
| 831,149 | A | | 9/1906 | Faller |
| 849,970 | A | | 4/1907 | Boyton |
| 868,736 | A | | 10/1907 | Washington |
| 879,283 | A | | 2/1908 | Mayberry et al. |
| 883,441 | A | | 3/1908 | Andrews |
| 891,388 | A | | 6/1908 | Visser et al. |
| 896,940 | A | | 8/1908 | Rosen |
| 904,848 | A | | 11/1908 | DeVore |
| 931,863 | A | | 8/1909 | Haight |
| 929,972 | A | | 9/1909 | M'Giehan |
| 952,673 | A | | 3/1910 | Karr |
| 1,004,174 | A | | 9/1911 | Kavakos |
| 1,056,929 | A | | 3/1913 | Navarro |
| 1,062,838 | A | | 5/1913 | Miller |
| 1,063,949 | A | | 6/1913 | Bedient |
| 1,095,965 | A | | 5/1914 | Glazier |
| 1,124,950 | A | | 1/1915 | Reagen et al. |
| 1,158,295 | A | | 10/1915 | Rodriguez |
| 1,159,519 | A | | 11/1915 | Menier |
| 1,167,993 | A | | 1/1916 | Guzendorfer |
| 1,195,707 | A | | 8/1916 | Miller |
| 1,198,749 | A | | 9/1916 | Myers |
| 1,230,559 | A | | 6/1917 | Burke |
| 1,249,455 | A | | 12/1917 | Myers |
| 1,320,124 | A | | 10/1919 | Chrul |
| 1,378,635 | A | | 5/1921 | Unger |
| 1,399,469 | A | | 12/1921 | Cucullu |
| 1,417,570 | A | | 5/1922 | Ridgway |
| 1,440,661 | A | | 1/1923 | Dickinson |
| 1,441,126 | A | | 1/1923 | Sherman et al. |
| 1,448,306 | A | | 3/1923 | Lezert |
| 1,497,754 | A | | 6/1924 | Howard |
| 1,520,217 | A | | 12/1924 | Auperl |
| 1,540,635 | A | | 6/1925 | Kohl |
| 1,551,249 | A | | 8/1925 | Held |
| 1,563,855 | A | | 12/1925 | Held |
| 1,591,566 | A | | 7/1926 | Schmidt et al. |
| 1,601,483 | A | | 9/1926 | Vaszin |
| 1,606,024 | A | | 11/1926 | Gorhum et al. |
| 1,606,854 | A | | 11/1926 | Vaszin |
| 1,607,771 | A | | 11/1926 | Miller |
| 1,609,922 | A | | 12/1926 | Wiig |
| 1,648,196 | A | | 11/1927 | Rohmer |
| 1,763,976 | A | | 6/1930 | Lippincott |
| 1,783,268 | A | | 12/1930 | Traver |
| 1,849,226 | A | | 3/1932 | Erban |
| 1,859,267 | A | | 5/1932 | Kurz |
| 1,893,167 | A | | 1/1933 | Glagolin |
| 1,926,780 | A | | 9/1933 | Lippincott |
| 2,064,035 | A | | 12/1936 | Rynearson |
| 2,146,631 | A | | 2/1939 | Kish |
| 2,484,466 | A | | 10/1949 | Rumler |
| 2,705,144 | A | | 3/1955 | Ridgway |
| 2,738,885 | A | | 3/1956 | Demaline |
| 2,888,205 | A | | 5/1959 | Trucco |
| D190,127 | S | | 4/1961 | Fowler |
| 2,991,726 | A | | 7/1961 | Miller |
| 3,000,017 | A | | 9/1961 | Skovira |
| 3,003,430 | A | | 10/1961 | Hamel |
| 3,030,895 | A | | 4/1962 | Hamel |
| 3,113,528 | A | | 12/1963 | Morgan et al. |
| 3,114,333 | A | | 12/1963 | Fowler et al. |
| 3,116,925 | A | | 1/1964 | Welch |
| D204,282 | S | | 4/1966 | Morgan |
| 3,302,413 | A | | 2/1967 | Burnett |
| 3,390,640 | A | | 7/1968 | Couttet et al. |
| 3,404,635 | A | | 10/1968 | Bacon et al. |
| 3,456,943 | A | | 7/1969 | Brown |
| 3,473,334 | A | | 10/1969 | Dexter |
| 3,508,405 | A | | 4/1970 | Koch |
| 3,534,413 | A | | 10/1970 | Plasseraud |
| 3,598,402 | A | | 8/1971 | Frenzl |
| 3,690,265 | A | | 9/1972 | Horibata |
| 3,730,520 | A | | 5/1973 | Willis |
| D229,354 | S | | 11/1973 | Morgan |
| 3,827,387 | A | | 8/1974 | Morgan |
| 3,830,161 | A | | 8/1974 | Bacon |
| 3,838,648 | A | | 10/1974 | Dahlberg et al. |
| 3,853,067 | A | | 12/1974 | Bacon |
| 3,861,514 | A | | 1/1975 | Ling |
| 3,865,041 | A | | 2/1975 | Bacon |
| 3,890,655 | A | | 6/1975 | Mathis |
| 3,913,332 | A | | 10/1975 | Forsman |
| 3,923,301 | A | | 12/1975 | Myers |
| 3,930,450 | A | | 1/1976 | Symons |
| 3,956,779 | A | * | 5/1976 | Jewett ..... 4/504 |
| 4,001,899 | A | | 1/1977 | Mathis |
| 4,063,517 | A | | 12/1977 | Nardozzi, Jr. |
| 4,073,722 | A | | 2/1978 | Grutsch |
| 4,149,469 | A | | 4/1979 | Bigler |
| 4,149,710 | A | | 4/1979 | Rouchard |
| 4,175,361 | A | | 11/1979 | Kumode |
| 4,194,733 | A | | 3/1980 | Whitehouse, Jr. |
| 4,196,900 | A | | 4/1980 | Becker et al. |
| 4,198,043 | A | | 4/1980 | Timbes et al. |
| 4,205,785 | A | | 6/1980 | Stanley |
| 4,221,170 | A | | 9/1980 | Koudelka |
| 4,225,953 | A | | 9/1980 | Simon et al. |
| 4,278,247 | A | | 7/1981 | Joppe et al. |
| 4,299,171 | A | | 11/1981 | Larson |
| 4,305,117 | A | | 12/1981 | Evans |

4,337,704 A 7/1982 Becker et al.
4,376,404 A 3/1983 Haddad
D269,082 S 5/1983 Spieldiener
4,391,201 A 7/1983 Bailey
4,392,434 A 7/1983 Dürwald et al.
4,423,864 A 1/1984 Wiik
4,429,867 A 2/1984 Barber
4,484,739 A 11/1984 Kreinbihl et al.
4,484,836 A * 11/1984 Bailard ..... 405/64
4,501,434 A 2/1985 Dupuis
4,516,943 A 5/1985 Spieldiener et al.
4,543,886 A 10/1985 Spieldiener et al.
4,545,574 A 10/1985 Sassak
4,545,583 A 10/1985 Pearman et al.
4,558,474 A 12/1985 Bastenhof
4,564,190 A 1/1986 Frenzl
4,576,512 A * 3/1986 Combes et al. ..... 405/100
4,683,686 A 8/1987 Ozdemir
4,695,058 A 9/1987 Carter, III et al.
4,696,251 A 9/1987 Spieldiener et al.
4,741,388 A 5/1988 Kuroiwa
4,759,545 A 7/1988 Grable
4,778,430 A 10/1988 Goldfarb et al.
4,783,861 A 11/1988 Leurent
4,792,260 A 12/1988 Sauerbier
4,797,027 A 1/1989 Combes et al.
4,797,605 A 1/1989 Palanisamy
4,805,896 A * 2/1989 Moody ..... 472/117
4,805,897 A 2/1989 Dubeta
4,817,312 A 4/1989 Fuller et al.
4,836,521 A 6/1989 Barber
4,850,896 A 7/1989 Smith et al.
4,854,256 A 8/1989 Hayashi
4,905,987 A 3/1990 Frenzi
4,910,814 A 3/1990 Weiner
4,939,358 A 7/1990 Herman et al.
4,954,014 A 9/1990 Sauerbier et al.
4,960,275 A 10/1990 Magon
4,963,057 A 10/1990 Fournier
4,979,679 A 12/1990 Downs
4,984,783 A 1/1991 Fujimaki
4,986,784 A 1/1991 French
5,011,134 A * 4/1991 Langford ..... 472/117
5,011,161 A 4/1991 Galphin
5,020,465 A 6/1991 Langford
5,022,588 A 6/1991 Haase
5,033,392 A 7/1991 Schemitsch
5,069,387 A 12/1991 Alba
5,069,443 A 12/1991 Shiratori
5,073,082 A 12/1991 Radlik
5,092,268 A 3/1992 Taylor
5,115,908 A 5/1992 Williams
5,137,497 A 8/1992 Dubeta
5,143,107 A 9/1992 Kelley
D330,579 S 10/1992 Briggs
5,152,210 A 10/1992 Chen
5,167,321 A 12/1992 Brodrick, Sr.
5,171,101 A 12/1992 Sauerbier et al.
5,183,437 A 2/1993 Millay et al.
5,194,048 A 3/1993 Briggs
5,213,547 A 5/1993 Lochtefeld
5,219,315 A 6/1993 Fuller et al.
5,224,652 A 7/1993 Kessler
5,230,662 A 7/1993 Langford
5,236,280 A 8/1993 Lochtefeld
RE34,407 E 10/1993 Frenzl
5,253,864 A 10/1993 Heege et al.
5,265,373 A 11/1993 Vollebregt
5,265,802 A 11/1993 Hobbs et al.
5,271,692 A 12/1993 Lochtefeld
5,299,964 A 4/1994 Hopkins
5,320,362 A 6/1994 Bear et al.
5,323,307 A 6/1994 Wolf et al.
5,378,197 A 1/1995 Briggs
5,387,158 A 2/1995 Bertrand
5,393,170 A 2/1995 Lochtefeld
5,401,117 A 3/1995 Lochtefeld
5,403,238 A 4/1995 Baxter et al.
5,405,294 A 4/1995 Briggs
5,421,451 A 6/1995 Easton
5,421,782 A 6/1995 Lochtefeld
5,426,899 A 6/1995 Jones
5,427,574 A 6/1995 Donnelly-Weide
5,433,671 A 7/1995 Davis
5,437,463 A 8/1995 Fromm
5,439,170 A 8/1995 Dach
5,452,678 A 9/1995 Simpkins
5,453,054 A 9/1995 Langford
5,461,876 A 10/1995 Dressler
5,473,233 A 12/1995 Stull et al.
5,478,281 A 12/1995 Forton
5,482,510 A 1/1996 Ishii et al.
5,494,729 A 2/1996 Henry et al.
5,499,821 A 3/1996 Rycroft
5,503,597 A 4/1996 Lochtefeld et al.
5,513,470 A 5/1996 Vollebregt
5,536,210 A 7/1996 Barber
5,540,622 A 7/1996 Gold et al.
5,564,859 A 10/1996 Lochtefeld
5,564,984 A 10/1996 Mirabella et al.
5,581,954 A 12/1996 Vollebregt
5,613,443 A 3/1997 Ariga et al.
5,623,986 A 4/1997 Wiggs
5,628,584 A 5/1997 Lochtefeld
5,649,867 A 7/1997 Briggs
5,662,525 A 9/1997 Briggs
5,664,910 A 9/1997 Lochtefeld et al.
5,667,445 A 9/1997 Lochtefeld
5,678,956 A * 10/1997 Freelain ..... 405/99
5,685,778 A 11/1997 Sheldon et al.
5,704,294 A 1/1998 Van Winkle et al.
5,716,282 A 2/1998 Ring et al.
5,732,635 A 3/1998 McKoy
5,735,748 A 4/1998 Meyers et al.
5,738,590 A 4/1998 Lochtefeld
5,741,189 A 4/1998 Briggs
5,761,776 A 6/1998 Vollebregt
5,766,082 A 6/1998 Lochtefeld et al.
5,779,553 A 7/1998 Langford
5,785,592 A 7/1998 Jacobsen
5,791,254 A 8/1998 Mares et al.
5,809,701 A 9/1998 Vollebregt
5,816,314 A 10/1998 Wiggs et al.
5,820,471 A 10/1998 Briggs
5,820,472 A 10/1998 Briggs
D403,392 S 12/1998 Briggs et al.
5,853,332 A 12/1998 Briggs
5,860,364 A 1/1999 McKoy
5,860,766 A 1/1999 Lochtefeld et al.
5,865,680 A 2/1999 Briggs
D406,871 S 3/1999 Briggs
D407,133 S 3/1999 Briggs
5,899,633 A 5/1999 Lochtefeld
5,899,634 A 5/1999 Lochtefeld
5,911,190 A 6/1999 Lochtefeld et al.
5,927,478 A 7/1999 Archer
D413,957 S 9/1999 Briggs
5,950,253 A 9/1999 Last
5,967,901 A 10/1999 Briggs
D416,066 S 11/1999 Briggs
5,978,593 A 11/1999 Sexton
5,989,126 A 11/1999 Kilbert et al.
6,006,672 A 12/1999 Newfarmer et al.
D421,283 S 2/2000 Briggs et al.
6,036,603 A 3/2000 Mason et al.
6,045,449 A 4/2000 Aragona et al.

| | | | |
|---|---|---|---|
| 6,075,442 | A | 6/2000 | Welch |
| 6,089,987 | A | 7/2000 | Briggs |
| 6,105,527 | A | 8/2000 | Lochtefeld et al. |
| 6,113,506 | A | 9/2000 | Nielsen |
| 6,115,974 | A | 9/2000 | Milanian |
| 6,132,317 | A | 10/2000 | Lochtefeld |
| 6,132,318 | A | 10/2000 | Briggs |
| 6,139,382 | A | 10/2000 | Eschbacher et al. |
| 6,146,282 | A | 11/2000 | McCready et al. |
| 6,161,771 | A | 12/2000 | Henry |
| 6,162,127 | A | 12/2000 | Ochi |
| 6,174,242 | B1 | 1/2001 | Briggs et al. |
| 6,178,692 | B1 | 1/2001 | Graven |
| 6,186,902 | B1 | 2/2001 | Briggs |
| 6,195,851 | B1 | 3/2001 | Vollebregt et al. |
| 6,210,287 | B1 | 4/2001 | Briggs |
| 6,231,451 | B1 | 5/2001 | Briggs |
| 6,237,499 | B1 | 5/2001 | McKoy |
| 6,261,186 | B1 | 7/2001 | Henry |
| 6,264,202 | B1 | 7/2001 | Briggs |
| 6,265,977 | B1 | 7/2001 | Vega et al. |
| 6,272,695 | B1 | 8/2001 | Brandner |
| 6,276,353 | B1 | 8/2001 | Briggs et al. |
| 6,280,342 | B1 | 8/2001 | Tod |
| 6,283,871 | B1 | 9/2001 | Briggs |
| 6,319,137 | B1 | 11/2001 | Lochtefeld |
| 6,320,495 | B1 | 11/2001 | Sporgis |
| 6,336,771 | B1 | 1/2002 | Hill |
| 6,354,955 | B1 | 3/2002 | Stuart et al. |
| 6,362,778 | B2 | 3/2002 | Neher |
| 6,371,717 | B1 | 4/2002 | Grams et al. |
| 6,375,578 | B1 | 4/2002 | Briggs |
| 6,443,849 | B1 | 9/2002 | Byrd |
| 6,460,201 | B1 | 10/2002 | Lochtefeld |
| 6,475,095 | B1 | 11/2002 | Henry |
| 6,488,590 | B2 | 12/2002 | Katayama |
| 6,491,589 | B1 | 12/2002 | Lochtefeld |
| 6,513,284 | B1 | 2/2003 | Sandlin |
| 6,520,853 | B2 | 2/2003 | Suzuki |
| 6,526,158 | B1 | 2/2003 | Goldberg |
| 6,527,646 | B1 | 3/2003 | Briggs |
| 6,533,191 | B1 | 3/2003 | Berger et al. |
| 6,553,336 | B1 | 4/2003 | Johnson et al. |
| 6,561,914 | B2 | 5/2003 | Henry |
| 6,569,023 | B1 | 5/2003 | Briggs |
| 6,579,175 | B2 | 6/2003 | Suzuki |
| 6,604,327 | B1 | 8/2003 | Reville |
| 6,608,563 | B2 | 8/2003 | Weston et al. |
| 6,634,949 | B1 | 10/2003 | Briggs et al. |
| 6,651,268 | B1 | 11/2003 | Briggs |
| 6,676,530 | B2 | 1/2004 | Lochtefeld |
| 6,702,687 | B1 | 3/2004 | Henry |
| 6,708,706 | B1 | 3/2004 | Robinson |
| 6,716,107 | B2 | 4/2004 | Lochtefeld |
| 6,738,992 | B2 | 5/2004 | Lochtefeld |
| 6,758,231 | B1 | 7/2004 | Lochtefeld et al. |
| 6,773,355 | B1 | 8/2004 | Lekhtman |
| 6,786,830 | B2 | 9/2004 | Briggs et al. |
| 6,789,608 | B1 | 9/2004 | Wiggs |
| 6,796,908 | B2 | 9/2004 | Weston |
| 6,830,146 | B1 | 12/2004 | Scully et al. |
| 6,928,670 | B2 | 8/2005 | Lochtefeld et al. |
| 6,957,662 | B2 | 10/2005 | Lochtefeld et al. |
| 6,976,434 | B2 | 12/2005 | Roig et al. |
| 7,004,847 | B2 | 2/2006 | Henry |
| 7,029,400 | B2 | 4/2006 | Briggs |
| 7,040,994 | B2 | 5/2006 | Lochtefeld et al. |
| RE39,171 | E | 7/2006 | Lochtefeld |
| 7,179,173 | B2 | 2/2007 | Henry et al. |
| 7,229,359 | B2 | 6/2007 | Henry et al. |
| 7,263,805 | B2 | 9/2007 | Chapus |
| 7,285,053 | B2 | 10/2007 | Henry et al. |
| 7,371,182 | B2 | 5/2008 | Henry et al. |
| 7,371,183 | B2 | 5/2008 | Henry et al. |
| 7,401,786 | B2 | 7/2008 | Lochtefeld |
| 2002/0072317 | A1 | 6/2002 | Livingston et al. |
| 2002/0082097 | A1 | 6/2002 | Henry et al. |
| 2002/0180155 | A1 | 12/2002 | Lochtefeld |
| 2003/0190967 | A1 | 10/2003 | Henry |
| 2003/0203760 | A1 | 10/2003 | Henry et al. |
| 2004/0033833 | A1 | 2/2004 | Briggs et al. |
| 2004/0077423 | A1 | 4/2004 | Weston et al. |
| 2005/0034768 | A1 | 2/2005 | Lochtefeld et al. |
| 2005/0047869 | A1 | 3/2005 | Lochtefeld |
| 2005/0085306 | A1 | 4/2005 | Henry et al. |
| 2005/0090318 | A1 | 4/2005 | Henry et al. |
| 2005/0090319 | A1 | 4/2005 | Henry et al. |
| 2005/0090320 | A1 | 4/2005 | Henry et al. |
| 2005/0090322 | A1 | 4/2005 | Henry et al. |
| 2005/0143173 | A1 | 6/2005 | Barney et al. |
| 2005/0148398 | A1 | 7/2005 | Lochtefeld et al. |
| 2005/0286976 | A1 | 12/2005 | Lochtefeld et al. |
| 2005/0288111 | A1 | 12/2005 | Cowan et al. |
| 2006/0052171 | A1 | 3/2006 | Henry et al. |
| 2006/0111195 | A1 | 5/2006 | Henry |
| 2006/0111196 | A1 | 5/2006 | Henry |
| 2006/0135274 | A1 | 6/2006 | Henry |
| 2006/0142090 | A1 | 6/2006 | Henry |
| 2006/0154726 | A1 | 7/2006 | Weston et al. |
| 2006/0178222 | A1 | 8/2006 | Henry et al. |
| 2006/0214805 | A1 | 9/2006 | Boujon |
| 2006/0229134 | A1 | 10/2006 | Briggs et al. |
| 2006/0258471 | A1 | 11/2006 | Briggs et al. |
| 2006/0260697 | A1 | 11/2006 | Lochtefeld et al. |
| 2006/0287030 | A1 | 12/2006 | Briggs et al. |
| 2007/0033866 | A1 | 2/2007 | Henry |
| 2007/0033867 | A1 | 2/2007 | Henry |
| 2007/0033868 | A1 | 2/2007 | Henry |
| 2007/0049385 | A1 | 3/2007 | Henry |
| 2007/0049386 | A1 | 3/2007 | Henry |
| 2007/0049387 | A1 | 3/2007 | Henry |
| 2007/0049388 | A1 | 3/2007 | Henry |
| 2007/0051036 | A1 | 3/2007 | Henry |
| 2007/0051037 | A1 | 3/2007 | Henry |
| 2007/0051038 | A1 | 3/2007 | Henry |
| 2007/0051039 | A1 | 3/2007 | Henry |
| 2007/0054745 | A1 | 3/2007 | Henry |
| 2007/0060402 | A1 | 3/2007 | Henry |
| 2007/0060403 | A1 | 3/2007 | Henry |
| 2007/0060404 | A1 | 3/2007 | Henry |
| 2007/0066396 | A1 | 3/2007 | Weston et al. |
| 2007/0066410 | A1 | 3/2007 | Henry |
| 2007/0078016 | A1 | 4/2007 | Henry |
| 2007/0087849 | A1 | 4/2007 | Henry |
| 2007/0087850 | A1 | 4/2007 | Henry |
| 2007/0087851 | A1 | 4/2007 | Henry |
| 2007/0087852 | A1 | 4/2007 | Henry |
| 2007/0087853 | A1 | 4/2007 | Henry |
| 2007/0087854 | A1 | 4/2007 | Henry |
| 2007/0197304 | A1 | 8/2007 | Henry et al. |
| 2007/0219004 | A1 | 9/2007 | Henry et al. |
| 2007/0249425 | A1 | 10/2007 | Weston et al. |
| 2008/0014835 | A1 | 1/2008 | Weston et al. |
| 2008/0021776 | A1 | 1/2008 | Lochtefeld |
| 2008/0216427 | A1 | 9/2008 | Lochtefeld |

FOREIGN PATENT DOCUMENTS

| | | |
|---|---|---|
| DE | 129145 | 3/1902 |
| DE | 893778 | 10/1953 |
| DE | 4243812 A1 | 6/1994 |
| EP | 1318864 | 6/2003 |
| EP | 1604712 | 12/2005 |
| WO | 92/03201 | 3/1992 |
| WO | 92/04087 | 3/1992 |
| WO | 97/33668 | 9/1997 |

| | | |
|---|---|---|
| WO | 98/45006 | 10/1998 |
| WO | 01/10184 | 2/2001 |
| WO | 02/22226 | 3/2002 |
| WO | 02/22227 | 3/2002 |
| WO | 2005/042124 | 5/2005 |
| WO | 2006/057970 | 6/2006 |
| WO | 2006/113936 | 10/2006 |
| WO | 2007/019278 | 2/2007 |
| WO | 2007/027841 | 3/2007 |
| WO | 2007/028040 | 3/2007 |
| WO | 2007/028042 | 3/2007 |
| WO | 2007/028043 | 3/2007 |
| WO | 2007/035524 | 3/2007 |
| WO | 2007/106717 | 9/2007 |

OTHER PUBLICATIONS

Written Opinion for PCT/US01/28535 mailed May 2, 2002.
Written Opinion for PCT/USO1/28535 mailed Aug. 6, 2002.
International Preliminary Examination Report for PCT/US01/28535 issued Jan. 13, 2003.
Rorres, C. "The Turn of the Screw: Optimal Design of an Archimedes Screw" J. of Hydraulic Engineering, Jan. 2000, vol. 126, No. 1, pp. 72-80.
Office Action for U.S. Appl. No. 10/693,654 mailed on Dec. 7, 2004.
Office Action for U.S. Appl. No. 10/693,654 mailed on Jun. 10, 2005.
International Search Report for PCT/US01/28542 mailed Mar. 27, 2002.
Written Opinion for PCT/US01/28542 mailed May 2, 2002.
Written Opinion for PCT/US01/28542 issued Aug. 5, 2002.
International Preliminary Examination Report for PCT/US01/28542 issued Dec. 2, 2002.
Written Opinion for 01 970 881.7—2307 mailed Apr. 13, 2004.
Written Opinion for 01 970 881.7—2307 mailed Oct. 21, 2004.
Engineering drawing (as well as photographs of the finished product) for the Silver Dollar City water slide in Branson, Missouri, the date is unknown, however there is a 1986 copyright on the engineering drawing.
European Search Report for EP 05019093.3 mailed Oct. 28, 2005.
Office Action for U.S. Appl. No. 11/244,866 mailed on Mar. 26, 2008, available in PAIR.
Office Action for U.S. Appl. No. 11/215,747 mailed on Mar. 18, 2008, available in PAIR.
Office Action for U.S. Appl. No. 11/215,795 mailed on Mar. 17, 2008, available in PAIR.
Office Action for U.S. Appl. No. 11/218,330 mailed on Mar. 25, 2008, available in PAIR.
AA51—International Search Report and Written Opinion for PCT/US06/15503 mailed Jul. 6, 2007.
AA52—International Search Report and Written Opinion for PCT/US06/34264 mailed Jul. 24, 2007.
AA38—Exhibits related to the "Gravity Groove" slide (Sep. 1995).
AA41—Exhibits related to the "Mountain Slidewinder" ride.
Office Action for U.S. Appl. No. 11/244,869 mailed on Apr. 8, 2008, available in PAIR.
Office Action for U.S. Appl. No. 11/407,862 mailed on Aug. 27, 2008, availaible in PAIR.
Office Action for U.S. Appl. No. 11/407,885 mailed on Sep. 5, 2008, availaible in PAIR.
Office Action for U.S. Appl. No. 11/513,338 mailed on Jun. 12, 2008, available in PAIR.
Office Action for U.S. Appl. No. 11/283,503 mailed on Mar. 28, 2008, available in PAIR.
AA74—Examiner's Report for Australian Patent Application No. 2004285488 mailed Sep. 19, 2008.
Office Action for U.S. Appl. No. 11/244,866 mailed on Sep. 23, 2008, available in PAIR.
Office Action for U.S. Appl. No. 11/407,874 mailed on Sep. 8, 2008, available in PAIR.
Office Action for U.S. Appl. No. 11/407,886 mailed on Sep. 9, 2008, available in PAIR.
Office Action for U.S. Appl. No. 11/407,845 mailed on Oct. 17, 2008, availaible in PAIR.
Office Action for U.S. Appl. No. 11/215,795 mailed on Oct. 9, 2008, available in PAIR.
Office Action for U.S. Appl. No. 11/218,330 mailed on Sep. 23, 2008, available in PAIR.
Office Action for U.S. Appl. No. 11/283,503 mailed on Sep. 26, 2008, available in PAIR.
Co-Pending U.S. Appl. No. 12/338,535 entitled, "Themed Amusement River Ride System" to Henry filed Dec. 18, 2008; available in private PAIR.
Office Action for U.S. Appl. No. 11/244,869 mailed on Nov. 13, 2008, available in PAIR.
Office Action for U.S. Appl. No. 11/407,885 mailed on Jan. 30, 2009, availaible in PAIR.
Office Action for U.S. Appl. No. 11/513,338 mailed on Dec. 10, 2008, available in PAIR.
Office Action for U.S. Appl. No. 11/215,747 mailed on Oct. 24, 2008, available in PAIR.
AA77—International Search Report and Written Opinion for PCT/US06/33955 mailed Apr. 4, 2008.
Office Action for U.S. Appl. No. 11/244,866 mailed on Feb. 24, 2009, available in PAIR.
Office Action for U.S. Appl. No. 11/244,869 mailed on Apr. 14, 2009, available in PAIR.
Office Action for U.S. Appl. No. 11/407,861 mailed on Mar. 12, 2009, availaible in PAIR.
Office Action for U.S. Appl. No. 11/407,845 mailed on Apr. 16, 2009, availaible in PAIR.
Office Action for U.S. Appl. No. 11/215,795 mailed on Feb. 26, 2009, available in PAIR.
Office Action for U.S. Appl. No. 11/218,330 mailed on Mar. 20, 2009, available in PAIR.
Office Action for U.S. Appl. No. 11/283,503 mailed on Mar. 10, 2009, available in PAIR.
Office Action for U.S. Appl. No. 11/215,747 mailed on May 18, 2009, available in PAIR.
Office Action for U.S. Appl. No. 11/244,866 mailed on Oct. 21, 2009, available in PAIR.
Office Action for U.S. Appl. No. 11/407,862 mailed on Nov. 30, 2009, availaible in PAIR.
Office Action for U.S. Appl. No. 11/407,861 mailed on Oct. 15, 2009, availaible in PAIR.
Office Action for U.S. Appl. No. 11/407,874 mailed on Dec. 1, 2009, available in PAIR.
Office Action for U.S. Appl. No. 11/407,886 mailed on Nov. 18, 2009, available in PAIR.
Office Action for U.S. Appl. No. 11/407,845 mailed on Oct. 16, 2009, availaible in PAIR.
Office Action for U.S. Appl. No. 11/407,885 mailed on Dec. 2, 2009, availaible in PAIR.
Office Action for U.S. Appl. No. 11/513,338 mailed on Dec. 10, 2009, available in PAIR.
Office Action for U.S. Appl. No. 11/215,747 mailed on Oct. 23, 2009, available in PAIR.
Office Action for U.S. Appl. No. 11/215,795 mailed on Nov. 18, 2009, available in PAIR.
Advisory Action for U.S. Appl. No. 11/218,330 mailed on Nov. 9, 2009, available in PAIR.
Office Action for U.S. Appl. No. 11/244,866 mailed on Jun. 26, 2009, available in PAIR.
Office Action for U.S. Appl. No. 11/244,869 mailed on Sep. 24, 2009, available in PAIR.
Office Action for U.S. Appl. No. 11/407,862 mailed on Jun. 24, 2009, available in PAIR.
Office Action for U.S. Appl. No. 11/407,874 mailed on Jul. 14, 2009, available in PAIR.
Office Action for U.S. Appl. No. 11/407,886 mailed on Jul. 13, 2009, available in PAIR.
Office Action for U.S. Appl. No. 11/513,338 mailed on Aug. 21, 2009, available in PAIR.
Office Action for U.S. Appl. No. 11/215,795 mailed on Jun. 23, 2009, available in PAIR.
AA79—International Search Report and Written Opinion for PCT/US2007/063611 mailed Nov. 10, 2008.

Office Action for U.S. Appl. No. 11/218,330 mailed on Jul. 22, 2009, available in PAIR.
AA80—European Office Action for EP 05019093.3 mailed Aug. 4, 2009.
Office Action for U.S. Appl. No. 11/283,503 mailed on Aug. 13, 2009, available in PAIR.
AA51—International Search Report and Written Opinion for PCT/US06/15503 mailed Jul. 6, 2007.
AA52—International Search Report and Written Opinion for PCT/US06/34264 mailed Jul. 24, 2007.
AA38—Exhibits related to the "Gravity Groove" slide (Sep. 1995).
AA41—Exhibits related to the "Mountain Slidewinder" ride (1987).
Office Action for U.S. Appl. No. 11/244,866 mailed on Mar. 26, 2010, available in PAIR.
Office Action for U.S. Appl. No. 11/244,869 mailed on Jan. 29, 2010, available in PAIR.
AA82 - Extended European Search Report for European Application No. 05 851 944.8 mailed on Jan. 13, 2010.
Office Action for U.S. Appl. No. 11/407,861 mailed on Mar. 17, 2010, available in PAIR.
Office Action for U.S. Appl. No. 11/407,845 mailed on Apr. 5, 2010, available in PAIR.
Office Action for U.S. Appl. No. 11/215,747 mailed on Feb. 25, 2010, available in PAIR.
Office Action for U.S. Appl. No. 11/218,330 mailed on Feb. 17, 2010, available in PAIR.

* cited by examiner

WATER AMUSEMENT PARK WATER CHANNEL AND ADJUSTABLE FLOW CONTROLLER

PRIORITY CLAIM

This patent application claims priority to U.S. Provisional Patent Application Ser. No. 60/705,298 entitled "JET AND SIDE CONTROL GATES" filed on Aug. 3, 2005, and to U.S. Provisional Patent Application Ser. No. 60/717,568 entitled "WATER AMUSEMENT PARK WATER BYPASS CHANNEL AND CHANNEL FLOW ADJUSTMENT SYSTEM" filed on Sep. 15, 2005, the disclosures of which are hereby incorporated by reference.

BACKGROUND

1. Field of the Invention

The present disclosure generally relates to water amusement attractions and rides. More particularly, the disclosure generally relates to jet and side control gates for controlling water flow in water amusement rides.

2. Description of the Relevant Art

The 80's decade witnessed phenomenal growth in the participatory family water recreation facility (i.e., the water park) and in water oriented ride attractions in the traditional themed amusement parks. The main current genre of water ride attractions (e.g., waterslides, river rapid rides, and log flumes, and others) require participants to walk or be mechanically lifted to a high point, wherein, gravity enables water, rider(s), and riding vehicle (if appropriate) to slide down a chute or incline to a lower elevation splash pool, whereafter the cycle repeats. Some rides can move riders uphill and downhill but for efficiency and performance reasons these rides also generally start on an elevated tower and generally require walking up steps to reach the start of the ride.

With this phenomenal growth came the subsequent problem of finding enough appropriate land available for development into water recreation facilities. One of the problems facing water park developers is finding enough land upon which to develop their water parks. The development of water parks is an expensive enterprise to which the addition of having to purchase large tracts of land only further adds to the expense of developing water parks.

Generally speaking, the traditional downhill water rides are short in duration (normally measured in seconds of ride time) and have limited throughput capacity. The combination of these two factors quickly leads to a situation in which patrons of the parks typically have long queue line waits of up to two or three hours for a ride that, although exciting, lasts only a few seconds. Additional problems like hot and sunny weather, wet patrons, and other difficulties combine to create a very poor overall customer feeling of satisfaction or perceived entertainment value in the water park experience. Poor entertainment value in water parks as well as other amusement parks is rated as the biggest problem of the water park industry and is substantially contributing to the failure of many water parks and threatens the entire industry.

Additionally, none of the typical downhill water park rides is specifically designed to transport guests between rides. In large amusement parks, transportation between rides or areas of the park may be provided by a train or monorail system, or guests are left to walk from ride to ride or area to area. Trains or monorails have relatively minor entertainment value and are passive in nature in that they have little if any active guest-controlled functions such as choice of pathway, speed of riders or rider activity besides sightseeing from the vehicle. They are also generally unsuitable for water parks because of their high installation and operating costs and have poor ambience within the parks. These types of transportation are also unsuitable for water park guests who, because of the large amount of time spent in the water, are often wet and want to be more active because of the combination of high ambient temperatures in summertime parks and the normal heat loss due to water immersion and evaporative cooling. Water helps cool guests and encourages a higher level of physical activity. Guests also want to stay in the water for fun. Water parks are designed around the original experience of a swimming hole combined with the river rafting or tubing. The preferred feeling is one of natural ambience and organic experience. A good river ride combines calm areas and excitement areas like rapids, whirlpools, and beaches. Mechanical transportation systems do not fit in well with these types of rides. There exists a need in water parks for a means of transportation through the park and between the rides.

For water rides that involve the use of a floatation device (e.g., an inner tube or floating board) the walk back to the start of a ride may be particularly arduous since the rider must usually carry the floatation device from the exit of the ride back to the start of the ride. Floatation devices could be transported from the exit to the entrance of the ride using mechanical transportation devices, but these devices are expensive to purchase and operate. Carrying the floatation device or using mechanical transportation to transport the floatation device may reduce guest enjoyment, cause excess wear and tear on the floatation devices, contribute to guest injuries, and/or make it impossible for some guests to access the rides. Also, a park that includes many different non-integrated rides may require guests to use different floatation devices for different rides, which makes it difficult for the park operators to provide the guests with a general purpose floatation device. It is advantageous to standardize riding vehicles for rides as much as possible.

Typically water parks are quite large in size. Typically guests must enter at one area and pass through a changing room area upon entering the park. Rides and picnic areas located in areas distant to the entry area are often underused in relation to rides and areas located near the entry area. More popular rides are overly filled with guests waiting in queue lines for entry. This leads to conditions of overcrowding in areas of the park which leads to guest dissatisfaction and general reduction of optimal guest dispersal throughout the park. The lack of an efficient transportation system between rides accentuates this problem in water parks.

For the reasons stated above and more, a natural and exciting water transportation system to transport participants between rides as well as between parks may be used to interconnect many diverse and stand-alone water park rides. The transportation system relieves the riders from the burden of carrying their floatation devices up to the start of a water ride. The transportation system also allows the riders to stay in the water, thus keeping the riders cool while they are transported to the start of the ride. The transportation system also may be used to transport guests from one end of a water park to the other, between rides and past rides and areas of high guest density, between water parks, or between guest facilities such as hotels, restaurants, and shopping centers. The transportation system itself may be a main attraction with exciting water and situational effects while seamlessly incorporating into itself other specialized or traditional water rides and events.

A transportation system may use sloped and/or flat water channels to transport participants. The depth and/or flow of water in these water channels may be controlled by narrowing or widening the water channels. Narrowing or widening the water channels may especially be useful in deeper water channels typically used for water amusement rides. Typically, a fast moving water section (e.g., a downhill or downhill rapids section) is located following a slow moving water section (e.g., a flat water section). The slow moving water section is typically an area used to collect and/or organize participants before they move into the fast moving water section. The fast moving water section may have a narrower cross-section so that water flows through the fast moving water section at a higher velocity.

It is important to control the water depth in the slow moving water section for several reasons. One reason is that the velocity (flow rate) and momentum of water entering the fast moving water section from the slow moving water section is dependent upon the head (depth) of water at the beginning of the fast moving water section. The depth of water at the beginning of the fast moving water section is dependent upon the depth of water in the slow moving water section.

A second reason is that the velocity of riders in the slow moving water section and upstream of the fast moving water section is determined by the width, depth, and water flow of the slow moving water section of the water channel. Typically, the width and water flow are assumed to be constant, so the velocity of the riders is mainly determined by the water depth in the slow moving water section. The water depth in the slow moving water section may be maintained at a desired level (e.g., a relatively constant level) by selectively restricting the flow of water out of the slow moving water section. A restriction in the flow of water out of the slow moving water section increases the head in the slow moving water section. This increase in head may be balanced by an increase in velocity of the water flowing past the restriction so that the water depth in the slow moving water section is maintained at the desired level. Thus, the velocity of riders in the slow moving water section may be controlled by selecting the water depth in the slow moving water section using the restriction. Selective adjustment of the restriction may be used to adjust water depth in the slow moving water section and control the velocity of riders in the slow moving water section.

Some examples of devices that are used to restrict water flow through an open channel include a sluice gate or an adjustable submerged obstruction (e.g., an adjustable weir). Sluice gates are typically unsuitable for use in water parks in which people participate due to safety reasons. Adjustable submerged obstructions are generally expensive and difficult to install in a water park and/or are unsuitable for controlling the flow of water in a water park. Adjustable side gates may be used to restrict water flow through an open channel. Adjustable side gates include moving parts that open and close into a water channel. The adjustable side gates may be manually controlled and/or actuated by mechanical means. These moving parts may be unsuitable for water parks because of safety issues involving riders in the water channel, especially for the high volume flows of water seen in water parks.

SUMMARY

In certain embodiments, a restriction in a water channel limits the amount of water flowing in the water channel. An adjustable bypass channel (e.g., a jet gate) may be used to limit the amount of water flowing in the water channel (i.e., the adjustable bypass channel is the restriction). A portion of the flow of water in the water channel may be diverted into the adjustable bypass channel. Adjusting the amount of water exiting the adjustable bypass channel adjusts the amount of water flowing in the water channel past the adjustable bypass channel. Restricting the amount of water flowing in the water channel controls the hydraulic profile of the water flowing in the channel without physically altering the width of the water channel.

In some embodiments, a bypass channel may be fixed, and a fixed bypass channel may be substituted within the context of the embodiments described herein.

In an embodiment, an adjustable bypass channel includes a water entrance, a water exit, and an adjustable valve (e.g., a butterfly valve). The water entrance is in fluid communication with water upstream of the adjustable bypass channel. The water exit is in fluid communication with water downstream of the adjustable bypass channel. The flow rate of water exiting the adjustable bypass channel may increase from the flow rate of water upstream of the adjustable bypass channel (e.g., the water may flow through a restriction that increases the velocity (flow rate) of the water in the adjustable bypass channel). The adjustable valve is located between the water entrance and the water exit. The adjustable valve may be adjusted to control an amount of water exiting the adjustable bypass channel and/or a depth of water in the water channel upstream of the adjustable bypass channel. The adjustable bypass channel may increase the flow rate of water between the water entrance and the water exit of the adjustable bypass channel.

The outer structure of the adjustable bypass channel may have fixed dimensions within the water channel. Typically, the only moving mechanical part in the adjustable bypass channel is the adjustable valve. Riders in the water channel may be inhibited from contacting any moving parts in the adjustable bypass channel.

A size of a restriction (e.g., an adjustable bypass channel) may be varied to compensate for variances in the flow of water in the water channel. For example, the flow of water may vary based on a design of a water amusement ride. The size of the restriction may be controllably varied. In certain embodiments, the size of the restriction is varied by adjusting the amount of water flowing in the water channel. A restriction in the amount of water flowing in the water channel may be controllably adjusted. The amount of water flowing in the water channel may be adjusted, for example, by adjusting an adjustable valve in an adjustable bypass channel or opening/closing adjustable gates to widen/narrow the width of the water channel.

In some embodiments, the size of a restriction is varied to change the hydraulic profile of the river (i.e., the flow of water) in a dynamic manner. The size of the restriction (e.g., the amount of water exiting an adjustable bypass channel) may be varied to partially or completely restrict the flow of water at various times during operation. The size of the restriction may be dynamically adjusted to create various sizes and/or shapes of water (e.g., waves or surges of water) in the downstream portion of the water channel. The dynamic adjustment of the size of the restriction may be used to create, for example, flash floods, river waves, or other dynamic effects.

In some embodiments, the restriction may be adjusted to completely close off the flow of water (e.g., the restriction operates as a dam). For example, an adjustable bypass channel may include inserts that may be used to completely close off the flow of water at the adjustable bypass channel. Completely closing off the flow of water may be useful during shutdown periods in a water park. During shutdown, water will run downhill along a sloping section to the lowest point in the water park. The amount of water held above base water level in the water park may be sufficient to flood lower sections of the water park during shutdown. Using a restriction to close off the flow of water in sections of the water park upstream from downhill or sloping sections may inhibit flooding in the lower sections of the water park.

In certain embodiments, restricting the flow of water in a section is used to selectively divert a portion of the flow of water through one or more alternative water channels without changing the bottom elevation of a water park river. Selectively diverting a portion of the flow of water may be used to create flows of water between loops of water and/or sections of a river in a water park between which water would not normally flow without mechanical means of moving water and riders (e.g., a conveyor). In some embodiments, selectively diverting a portion of the flow of water is accomplished with little or no dynamic alteration of the flow of water (e.g., little or no adjustment of the size of a restriction).

In some embodiments, a water ride may include a first channel of water which functions to convey participants in a first direction. A water ride may include a first adjustable flow controller positioned in the first channel of water. A water ride may include a second channel of water which functions to convey participants in a second direction different from the first direction. In certain embodiments, the second direction may be substantially opposite the first direction. A water ride may include a third channel coupling the first channel, upstream of the first adjustable flow controller, to the second channel. The first adjustable flow controller may function to control the flow of water through the third channel.

In some embodiments, a water ride may include a second adjustable flow controller positioned in the second channel of water. The third channel couples to the second channel downstream of the second adjustable flow controller. The water ride may include a fourth channel coupling the second channel, upstream of the second adjustable flow controller, to the first channel, downstream of the first adjustable flow controller. The second adjustable flow controller is configured to control the flow of water through the fourth channel.

In some embodiments, controlling the flow of water through the fourth channel may adjust a participant flow rate through the fourth channel. Controlling the flow of water through the third channel may adjust a participant flow rate through the third channel.

In some embodiments, water in the first channel upstream of the first adjustable flow controller may be at a substantially similar elevation to water in the second channel upstream of the second adjustable flow controller. Water in the first channel downstream of the first adjustable flow controller may be at a substantially similar elevation to water in the second channel downstream of the second adjustable flow controller. Water in the first channel upstream of the first adjustable flow controller may be at a higher elevation than water in the first channel downstream of the first adjustable flow controller. Water in the second channel upstream of the second adjustable flow controller may be at a higher elevation than water in the second channel downstream of the second adjustable flow controller.

In some embodiments, a first adjustable flow controller may function to control the amount of water flowing downstream of the first adjustable flow controller and the amount of water flowing through the third channel. A second adjustable flow controller may function to control the amount of water flowing downstream of the second adjustable flow controller and the amount of water flowing through the fourth channel.

In certain embodiments, a method for controlling a flow of water between two water channels in a water amusement park includes diverting at least a portion of the flow of water in a first channel of the water amusement ride into a third channel. A flow of water in the first channel may be controlled using a first adjustable flow controller to control the amount of water flowing in the first channel downstream of the first adjustable flow controller and the amount of water flowing in the third channel. At least a portion of the flow of water in a second channel of the water amusement ride may be diverted into a fourth channel. A flow of water in the second channel may be controlled using a second adjustable flow controller to control the amount of water flowing in the second channel downstream of the second adjustable flow controller and the amount of water flowing in the fourth channel. The flow of water in the water amusement ride may be controlled using the first adjustable flow controller and the second adjustable flow controller to substantially equalize the flow of water between the first channel and the second channel.

In some embodiments, two water channels may only be connected by a third channel and only the first channel may include a first adjustable flow controller. In some embodiments, a water ride may include a plurality of water channels and a plurality of interconnecting channels through which the flow of water is controlled by various adjustable flow controllers positioned in the plurality of channels.

BRIEF DESCRIPTION OF THE DRAWINGS

Advantages of the present invention may become apparent to those skilled in the art with the benefit of the following detailed description of the preferred embodiments and upon reference to the accompanying drawings.

Figure 1:
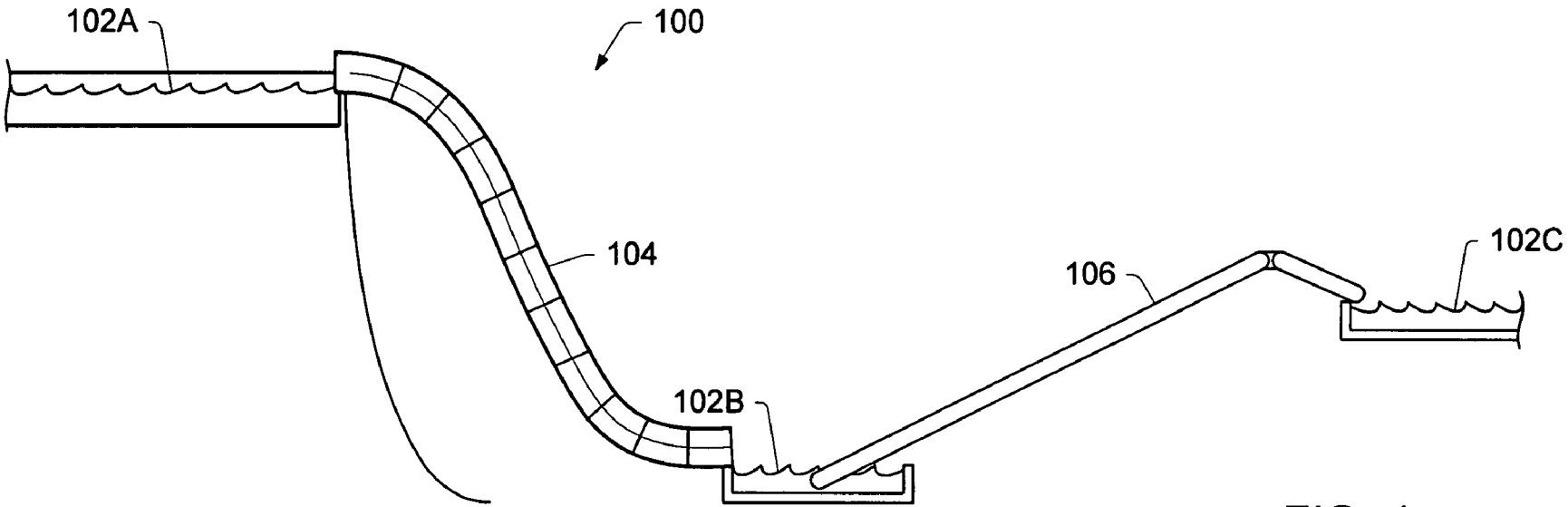
FIG. 1 depicts an embodiment of a portion of a continuous water slide.

While the invention is susceptible to various modifications and alternative forms, specific embodiments thereof are shown by way of example in the drawing and will herein be described in detail. It should be understood, however, that the drawings and detailed description thereto are not intended to limit the invention to the particular form disclosed, but on the contrary, the intention is to cover all modifications, equivalents, and alternatives falling within the spirit and scope of the present invention as defined by the appended claims.

DETAILED DESCRIPTION

In some embodiments, a water amusement system (e.g., a water park) may include a "continuous water ride." The continuous water ride may allow a participant using the continuous water ride to avoid long lines typically associated with many water amusement systems. Long lines and/or wait times are one of the greatest problems in the area of customer satisfaction associated with water amusement systems.

Almost all water park rides require substantial waiting periods in a queue line due to the large number of participants at the park. This waiting period is typically incorporated into the walk from the bottom of the ride back to the top, and can measure hours in length, while the ride itself lasts a few short minutes, if not less than a minute. A series of corrals are typically used to form a meandering line of participants that extends from the starting point of the ride toward the exit point of the ride. Besides the negative and time-consuming experience of waiting in line, the guests are usually wet, exposed to varying amounts of sun and shade, and are not able to stay physically active, all of which contribute to physical discomfort for the guest and lowered guest satisfaction. Additionally, these queue lines are difficult if not impossible for disabled guests to negotiate.

The concept of a continuous water ride was developed to address the problems and issues stated above associated with water amusement parks. Continuous water rides may assist in eliminating and/or reducing long queue lines. Continuous water rides may eliminate and/or reduce participants having to walk back up to an entry point of a water ride. Continuous water rides may also allow physically handicapped or physically challenged individuals to take advantage of water amusement parks by eliminating flights of stairs typically associated with water amusement parks.

In some embodiments, continuous water rides may include a system of individual water rides connected together. The system may include two or more water rides connected together. Water rides may include downhill water slides, uphill water slides, single tube slides, multiple participant tube slides, space bowls, sidewinders, interactive water slides, water rides with falling water, themed water slides, dark water rides, and/or accelerator sections in water slides. Connections may reduce long queue lines normally associated with individual water rides. Connections may allow participants to remain in the water and/or a vehicle (e.g., a floatation device) during transportation from a fist portion of the continuous water ride to a second portion of the continuous water ride.

In some embodiments, an exit point of a first water ride may be connected to an entry point of a second water ride, forming at least a portion of a continuous water ride. The exit point of the first water ride and the entry point of the second water ride may be at different elevations. An elevation system may be used to connect the exit point of the first water ride and the entry point of the second water ride. In some embodiments, an entry point of a second water ride may have a higher elevation than an exit point of a first water ride coupled to the entry point of the second water ride.

In some embodiments, elevation systems may include any system capable of transporting one or more participants and/or one or more vehicles from a first point at one elevation to a second point at a different elevation. Elevation systems may include a conveyor belt system. Elevation systems may include a water lock system. Elevation systems may include an uphill water slide, a spiral transport system, and/or a water wheel.

FIG. 1 depicts an embodiment of a portion of continuous water ride 100. Continuous water ride 100 may include body of water 102A. Body of water 102A may include pools, lakes, and/or wells. Body of water 102A may be a natural body of water, an artificial body of water, or an artificially modified natural body of water. A non-limiting example of an artificially modified natural body of water might include a natural lake that has been artificially enlarged and adapted for water amusement park purposes (e.g., entry ladders and/or entry steps). Continuous water ride 100 may include downhill water slide 104. Downhill water slide 104 may convey participants from body of water 102A at a first elevation to a lower second elevation into typically some type of water container (e.g., body of water, channel, floating queue line, and/or pool). The water container at the lower second elevation may include second body of water 102B (e.g., a pool). Continuous water ride 100 may include elevation system 106. Elevation system 106 may include any system capable of safely moving participants and/or vehicles from a lower elevation to a higher elevation. Elevation system 106 is depicted as a conveyor belt system in FIG. 1. Elevation system 106 may convey participants to body of water 102C.

Figure 2:
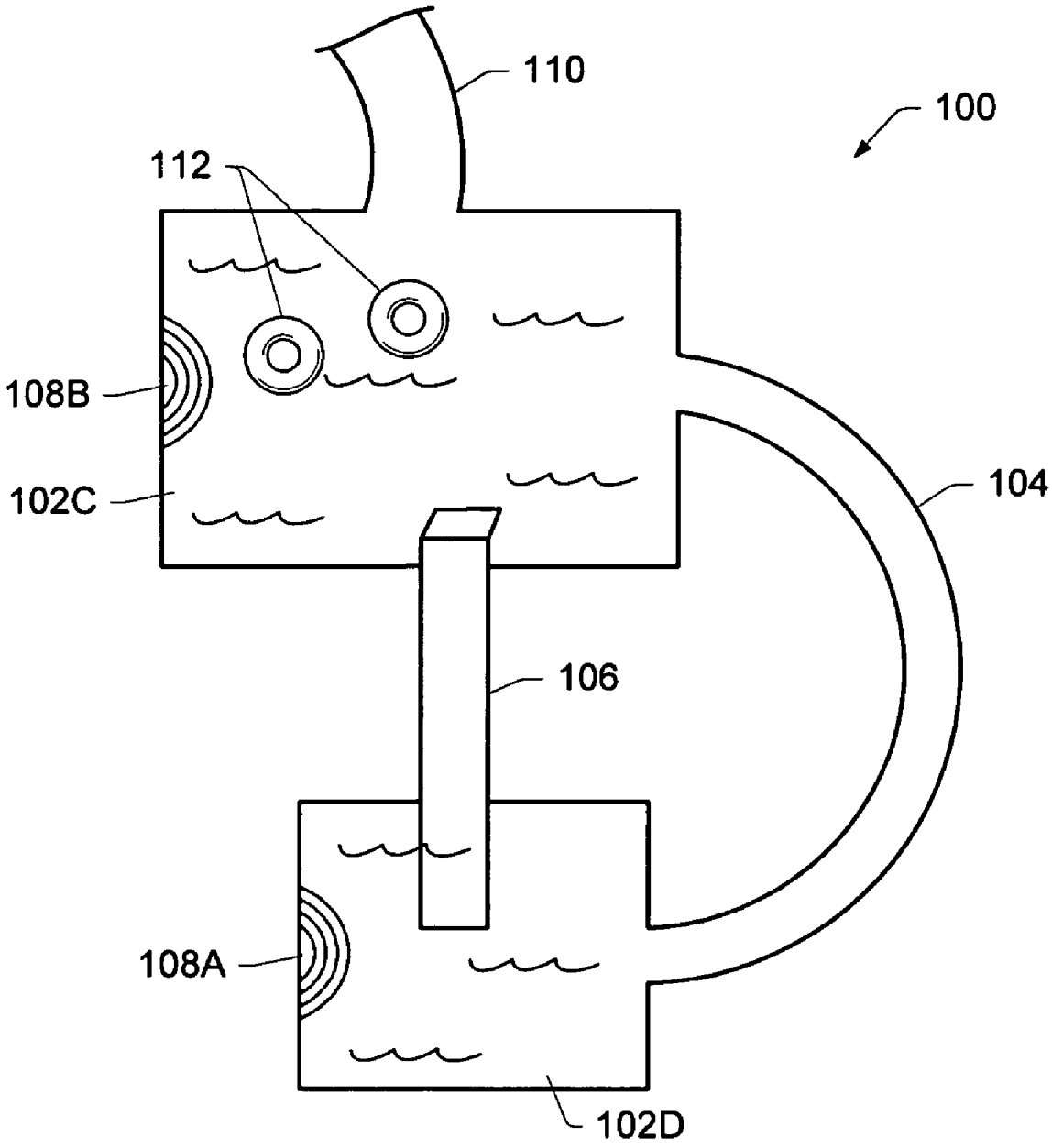
FIG. 2 depicts an embodiment of a portion of a continuous water slide.

FIG. 2 depicts an embodiment of a portion of continuous water ride 100. Continuous water ride 100 may include body of water 102C. Body of water 102C may be coupled to downhill water slide 104. Downhill water slide 104 may couple body of water 102C to body of water 102D. Body of water 102D may be positioned at a lower elevation than body of water 102C. Body of water 102D may include access point 108A. Access point 108A may allow participants to safely enter and/or exit body of water 102D. As depicted in FIG. 2, access points 108A, 108B may be stairs. Access points 108A, 108B may also include ladders and/or gradually sloping walkways. Body of water 102D may be coupled to body of water 102C with elevation system 106. Elevation system 106, as depicted in FIG. 2, is a conveyor belt system. Elevation system 106 may be any system of elevation described herein. Body of water 102C may be coupled to a second water ride. The second water ride may be, for example, lazy river 110.

FIG. 2 depicts a non-limiting example of continuous water ride 100. Continuous water ride 100 may allow participants in vehicles 112 (e.g., inner tubes) to ride continually without having to leave their vehicle. For example a participant may enter body of water 102C through access point 108B. The participant may ride vehicle 112 down downhill water slide 104 to body of water 102D. At this point the participant may choose between exiting body of water 102D at access point 108A or riding vehicle 112 up elevation system 106 to body of water 102C. One or both ends of elevation system 106 may extend below the surface of bodies of water 102C, 102D. Extending the ends of elevation system 106 below the surface of the water may allow participants to float up on elevation system 106 more safely. Participants who choose to ride elevation system 106 to body of water 102C may then choose to either exit access point 108B, ride downhill water slide 104 again, or ride lazy river 110.

In some embodiments, bodies of water 102 may include multiple elevation systems 106 and/or multiple water rides connected to each other. In some embodiments, floating queue lines and/or channels may couple water rides and/or elevation systems to each other. Floating queue lines may more efficiently control the flow of participants between portions of a water amusement park.

Figure 3:
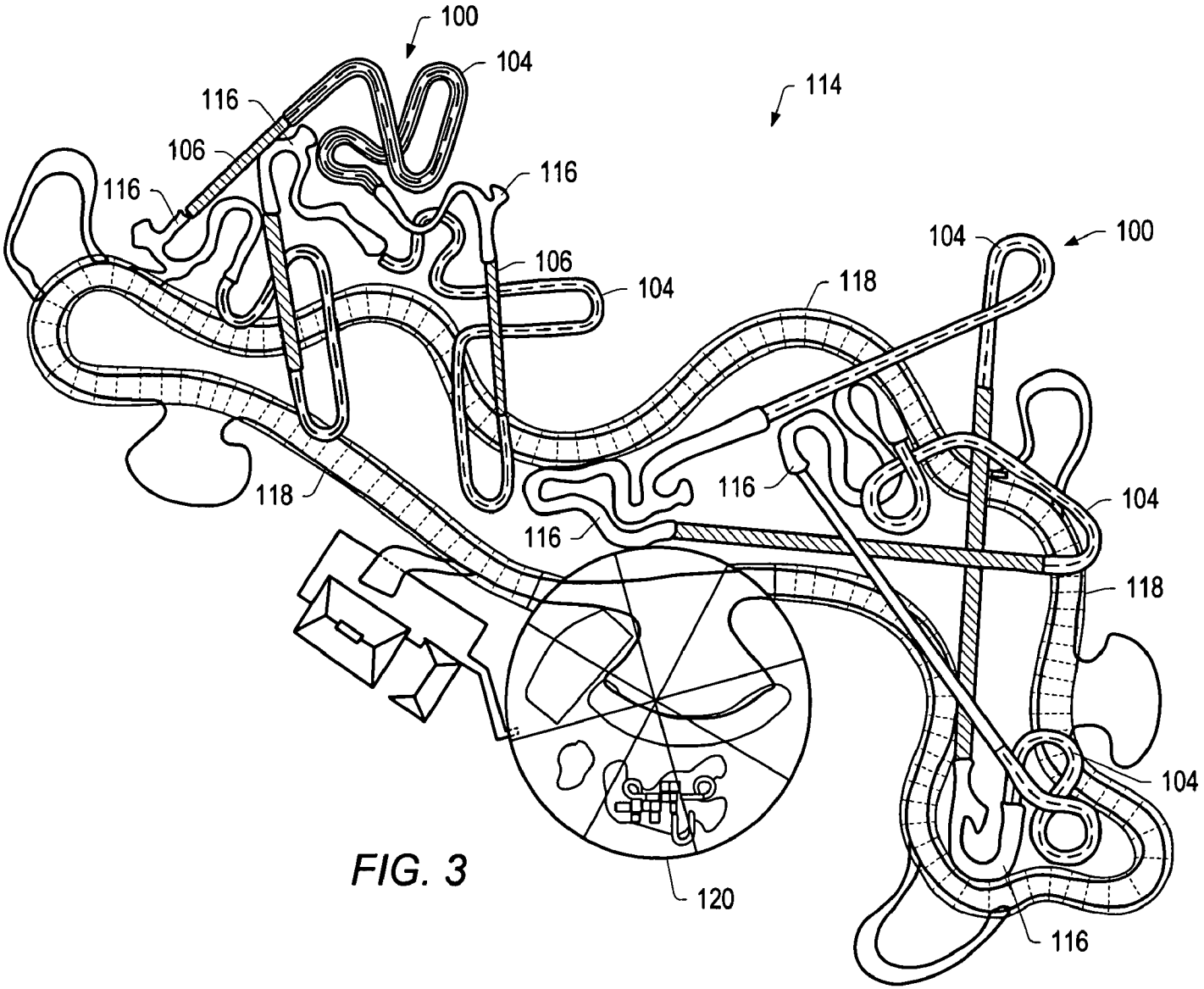
FIG. 3 depicts an embodiment of a water amusement park.

FIG. 3 depicts an embodiment of a water amusement park. Water amusement park 114 depicted in FIG. 3 shows several different examples of continuous water rides 100. Continuous water rides 100 may include elevation systems 106, downhill water slides 104, and floating queue systems 116. Elevation systems 106 may include, for example, conveyor belt systems as depicted in FIG. 3. Conveyor belt systems are described in U.S. Pat. No. 7,285,053, herein incorporated by reference. This system may include a conveyor belt system positioned to allow riders to naturally float or swim up onto the conveyor and be carried up and deposited at a higher level. Downhill water slides 104 may couple elevation systems 106 to floating queue systems 116. In some embodiments, water amusement park 114 may include screens 118 and/or domes 120.

The conveyor belt system may be used to take riders and vehicles out of the water flow at stations requiring entry and/or exit from the continuous water ride. Riders and vehicles may float to and be carried up on a moving conveyor. The riders may exit the vehicles at desired locations along the conveyor belt system. New riders may enter the vehicles and be transported into the continuous water ride at the desired locations. The conveyor may extend below the surface of the water to more easily allow riders to float or swim up onto the conveyor. Extending the conveyor below the surface of the water may allow for smoother entry into the water when exiting the conveyor belt. Typically, the conveyor belt takes riders and vehicles from a low elevation to a higher elevation. The higher elevation may be higher than the elevation of the final destination. Upon reaching the higher elevation (e.g., the apex), the riders then may be transported down to their final destination on a water slide, on rollers, or on a continuation of the original conveyor that transported them to the higher elevation. This serves the purpose of using gravity to push the rider off and away from the belt, slide, or rollers into a second water ride of the continuous water ride and/or a floating queue. The endpoint of a conveyor may be near a first end of a horizontal hydraulic head channel wherein input water is introduced through a first conduit. This current of flowing water may move the riders away from the conveyor endpoint in a quick and orderly fashion so as not to cause an increase in rider density at the conveyor endpoint. Moving the riders quickly away from the conveyor endpoint may act as a safety feature that reduces the risk of riders becoming entangled in any part of the conveyor belt or its mechanisms. A deflector plate may extend from one or more ends of the conveyor to the bottom of the channel. A deflector plate extending at an angle away from the conveyor it may help to guide the riders up onto the conveyor belt as well as inhibit access to the rotating rollers underneath the conveyor. Conveyors may be designed to lift riders from one level to a higher one, or may be designed to lift riders and vehicles out of the water onto a horizontal moving platform and then return the vehicle with a new rider to the water.

The conveyor belt speed may be adjusted in accordance with several variables. The belt speed may be adjusted depending on the rider density. For example, belt speed may be increased when rider density is high to reduce rider waiting time. The speed of the belt may be varied to match the velocity of the water, reducing changes in velocity experienced by the rider moving from one medium to another (for example from a current of water to a conveyor belt). Decreasing changes in velocity is an important safety consideration because large changes in velocity may cause a rider to become unbalanced. Conveyor belt speed may be adjusted so riders are discharged at predetermined intervals, which may be important when riders are launched from a conveyor to a water ride that requires safety intervals between the riders.

Several safety concerns should be addressed in connection with the conveyor system. The actual belt of the system should be made of one or more materials designed to provide good traction to riders and vehicles without proving uncomfortable to the riders' touch. The angle at which the conveyor is disposed is an important safety consideration and should be small enough so as not to cause the riders to become unbalanced or to slide in an uncontrolled manner along the conveyor belt. Detection devices or sensors for safety purposes may also be installed at various points along the conveyor belt system. These detection devices may be variously designed to determine if any rider on the conveyor is standing or otherwise violating safety parameters. Gates may be installed at the top or bottom of a conveyor. The gates may be arranged mechanically or with sensors so that the conveyor stops when the rider collides with the gate, thereby reducing the danger of the rider being caught in and pulled under the conveyor. Runners may cover the outside edges of the conveyor belt (e.g., the space between the conveyor and the outside wall of the conveyor) so that no part of a rider may be caught in this space. All hardware (electrical, mechanical, and otherwise) should be able to withstand exposure to water, sunlight, and various chemicals associated with water treatment (including chlorine or fluorine) as well as common chemicals associated with the riders themselves (such as the various components making up sunscreen or cosmetics).

Various sensors may be installed along the conveyor belt system to monitor the number of riders and/or rider density at various points along the system. Sensors may also monitor the actual conveyor belt system for breakdowns or other problems. Problems include, but are not limited to, inoperability of all or part of the conveyor belt. All of this information may be transferred to various central or local control stations where it may be monitored so adjustments may be made to improve efficiency of transportation of the riders. Some or all of these adjustments may be automated and controlled by a programmable logic control system.

Various embodiments of the conveyor lift station include widths allowing only one or several riders side by side to ride on the conveyor according to ride and capacity requirements. The conveyor may also include entry and exit lanes in the incoming and outgoing stream to better position riders onto the conveyor belt and into the outgoing stream.

Figure 4:
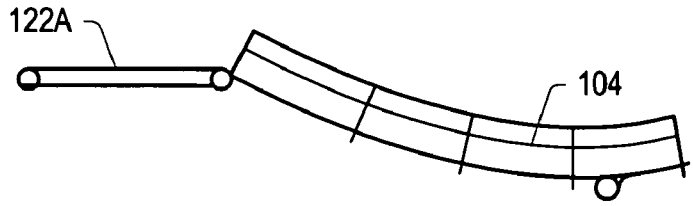
FIG. 4 depicts a side view of an embodiment of a conveyor lift station coupled to a water ride.
Figure 5:
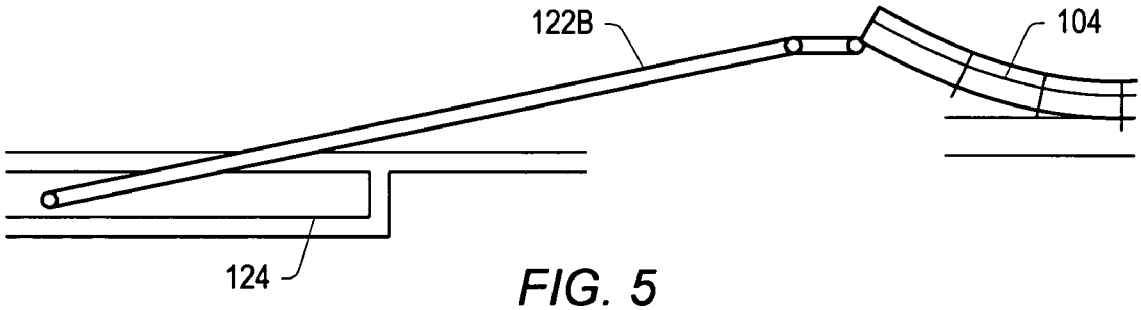
FIG. 5 depicts a side view of an embodiment of a conveyor lift station with an entry conveyor coupled to a water slide.
Figure 6:
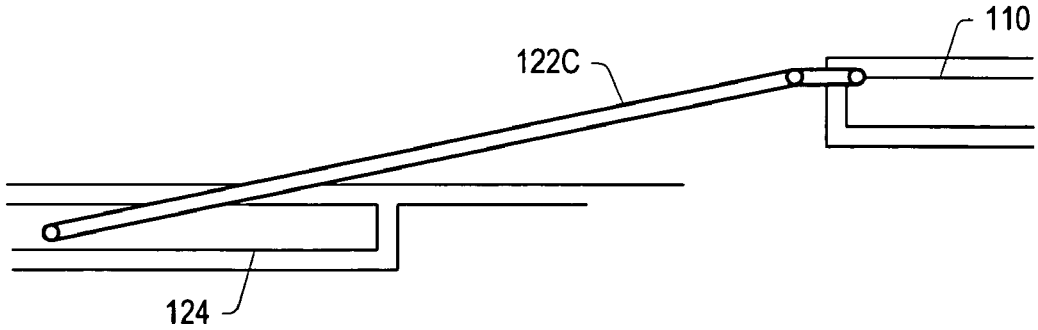
FIG. 6 depicts a side view of an embodiment of a conveyor lift station coupled to an upper channel.

More embodiments of conveyor systems (e.g., conveyor lift stations) with conveyors 122 are shown in FIGS. 4-6. FIG. 4 shows dry conveyor 122A for transporting riders entering the system into a channel. It includes a conveyor belt portion ending at the top of downhill slide 104, which riders slide from into the water. FIG. 5 depicts wet conveyor 122B for transporting riders from lower channel 124 to a higher channel 124 via downhill slide 104. FIG. 6 shows river conveyor 122C for transporting riders from channel 124 to lazy river 110. This embodiment does not have a descending portion.

In some embodiments, an exit point of a second water ride of a continuous water ride may be coupled to an entry point of a first water ride. Coupling the exit point of the second water ride to the entry point of the first water ride may form a continuous water ride loop. The continuous water ride may include a second elevation system coupling the exit point of the second water ride to the entry point of the first water ride. The second elevation system may include any of the elevation systems described for use in coupling an exit point of the first water ride to the entry point of the second water ride. The second elevation system may be a different elevation system than the first elevation system. For example, the first elevation system may be an uphill water slide and the second water elevation system may be a conveyor belt system.

In some embodiments, a continuous water ride may include one or more floating queue lines. Floating queue lines are described in U.S. Pat. No. 7,285,053. Floating queue lines may assist in coupling different portions of a continuous water ride. Floating queue line systems may be used for positioning riders in an orderly fashion and delivering them to the start of a ride at a desired time. In certain embodiments, this system may include a channel (horizontal or otherwise) coupled to a ride on one end and an elevation system on the other end. It should be noted, however, that any of the previously described elevation systems may be coupled to the water ride by the floating queue line system. Alternatively, a floating queue line system may be used to control the flow of participants into the continuous water ride from a dry position.

Riders desiring to participate on a water ride may leave a body of water and enter a floating queue line. The floating queue line may include pump inlets and outlets similar to those in a horizontal channel, but configured to operate intermittently to propel riders along the queue line. In some embodiments, the inlet and outlet may be used to keep a desired amount of water in the queue line. In the latter case, the channel may be configured with high velocity, low volume jets that operate intermittently to deliver participants to the end of the queue line at the desired time.

In certain embodiments, the water moves participants along the floating queue line down a hydraulic gradient or bottom slope gradient. The hydraulic gradient may be produced by out-flowing the water over a weir at one end of the queue after the rider enters the ride to which the queue line delivers them, or by out-flowing the water down a bottom slope that starts after the point that the rider enters the ride. In certain embodiments, the water moves through the queue channel by means of a sloping floor. The water from the outflow of the queue line in any method can reenter the main channel, another ride or water feature, or return to the system sump. Preferably the water level and width of the queue line are minimized for water depth safety, rider control and water velocity. These factors combine to deliver the participants to the ride in an orderly and safe fashion, at the preferred speed, and with minimal water volume usage. The preferred water depth, channel width and velocity would be set by adjustable parameters depending on the type of riding vehicle, participant comfort and safety, and water usage. Decreased water depth may also be influenced by local ordinances that determine level of operator or lifeguard assistance, the preferred being a need for minimal operator assistance consistent with safety.

In some embodiments, continuous water rides may include exits or entry points at different portions of the continuous water ride. Floating queue lines coupling different portions and/or rides forming a continuous water ride may include exit and/or entry points onto the continuous water ride. Exit/entry points may be used for emergency purposes in case of, for example, an unscheduled shutdown of the continuous water ride. Exit/entry points may allow participants to enter/exit the continuous water ride at various designated points along the ride during normal use of the continuous water ride. Participants entering/exiting the continuous water ride during normal use of the ride may not disrupt the normal flow of the ride depending on where the entry/exit points are situated along the course of the ride.

In certain embodiments, a continuous water ride includes flat and/or sloped water channels (e.g., deep water channels). Water flow in these water channels may be controlled by narrowing or widening the water flow channels. In certain embodiments, sloped water channels include downhill sections or downhill rapids sections. These downhill sections may have fast moving water. Downhill sections typically follow flat or slow moving water sections in a water amusement ride. The flat or slow moving water sections may be used as call areas to arrange or organize participants before entering the fast moving water sections. For example, participants may be queued up in the slow moving water section prior to being allowed to enter the fast moving water section.

Figure 7:
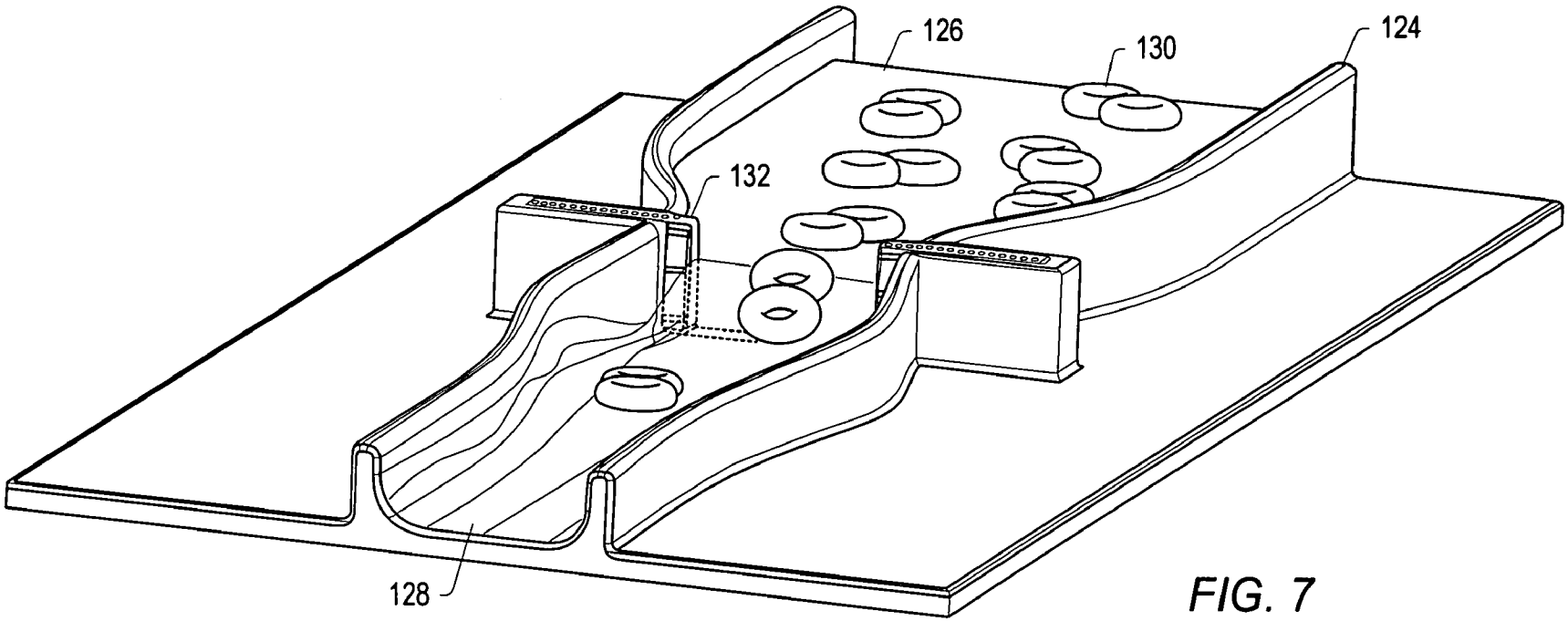
FIG. 7 depicts a perspective view of an embodiment of a portion of a water amusement ride with a slow moving water section preceding a fast moving water section.
Figure 8:
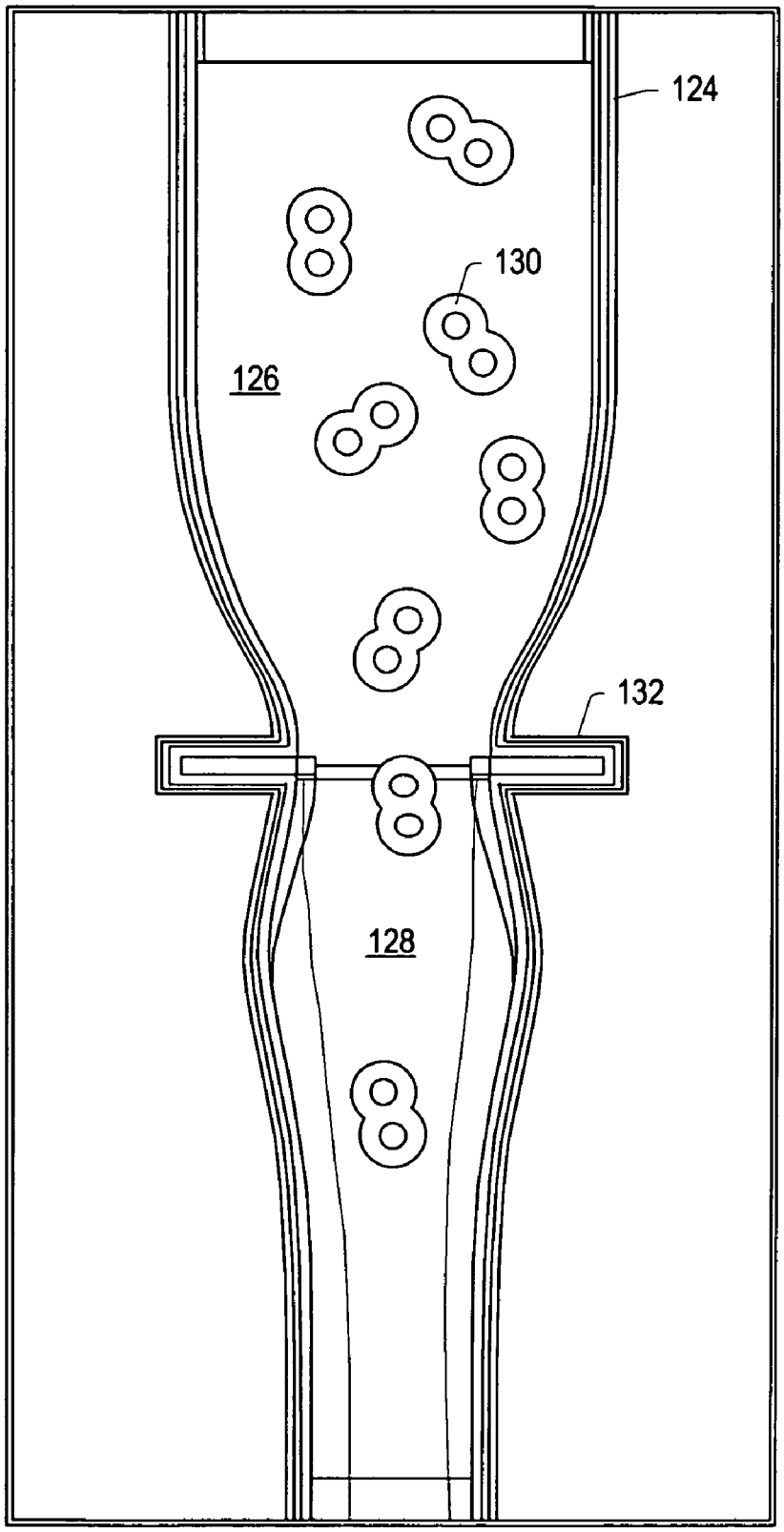
FIG. 8 depicts a top view of the embodiment depicted in FIG. 7.

FIG. 7 depicts a perspective view of an embodiment of a portion of a water amusement ride with a slow moving water section preceding a fast moving water section. FIG. 8 depicts a top view of the embodiment depicted in FIG. 7. Water channel 124 may be part of a water amusement ride. Water channel 124 may include slow moving water section 126 and fast moving water section 128. Water in fast moving water section 128 flows at a higher velocity than water in slow moving water section 126. In certain embodiments, fast moving water section 128 has a narrower width than slow moving water section 126. Fast moving water section 128 may have a narrower width and/or a downhill slope to create a higher velocity of water in the fast moving water section.

Participants may move through water channel 124 on floatation devices 130. Floatation devices 130 may be, for example, inner tubes or other floating methods of conveyance. Slow moving water section 126 is upstream from fast moving water section 128. Participants may be queued in slow moving water section 126 before proceeding into fast moving water section 128. In certain embodiments, fast moving water section 128 is sloped. In some embodiments, a transition between slow moving water section 126 and fast moving water section 128 is sloped.

In some embodiments, an adjustable flow controller may include a side gate (e.g., side gate 132). Side gate 132 may be located at the junction of slow moving water section 126 and fast moving water section 128. Side gate 132 may be used to restrict water flow between slow moving water section 126 and fast moving water section 128. Side gate 132 may be adjustably opened and closed into water channel 124. Side gate 132 may be opened or closed to control the flow of water between slow moving water section 126 and fast moving water section 128. Side gate 132 may be opened and/or closed manually or through actuated (e.g., mechanically controlled) means. Opening or closing of side gate 132 controllably widens or narrows the width of water channel 124 at side gate 132.

Controlling the width of water channel 124 at side gate 132 controls the water depth in slow moving water section 126. Side gate 132 may be used to restrict the flow of water out of slow moving water section 126 to control the water depth in the slow moving water section. Controlling the water depth in slow moving water section 126 may be used to control the velocity of water in the slow moving water section and, thus, control the velocity of participants in the slow moving water section.

In certain embodiments, side gate 132 is opened and/or closed to adjust the hydraulic profile of water in fast moving water section 128. Side gate 132 may be opened and/or closed to adjust the size and/or shape of waves in fast moving water section 128. In some embodiments, side gate 132 is opened and/or closed to create flash flood, river waves, or other dynamic effects.

In some embodiments, side gate 132 is used to completely close off water channel 124. Thus, side gate 132 may be used as a dam in water channel 124. For example, side gate 132 may be used to completely close off flow in water channel 124 during shut down periods of the water amusement ride. Using side gate 132 to dam off flow in water channel 124 may inhibit all of the water in the water channel from flowing downhill to a lower point in the water amusement ride. Holding water in the upper portions of the water amusement ride inhibits lower portions of the water amusement ride from flooding when the ride is shut down.

Figure 9:
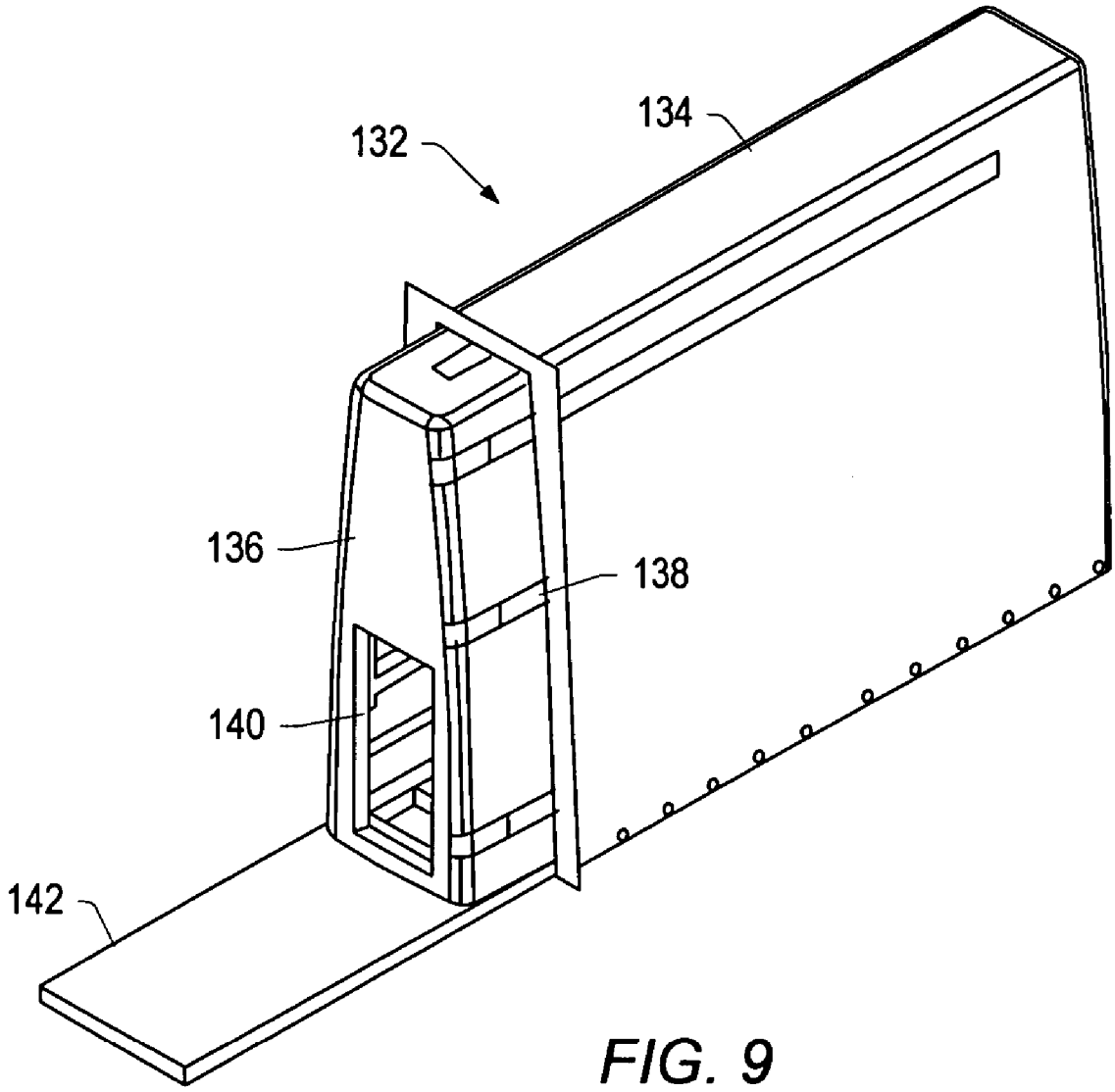
FIG. 9 depicts an embodiment of a gate.
Figure 10:
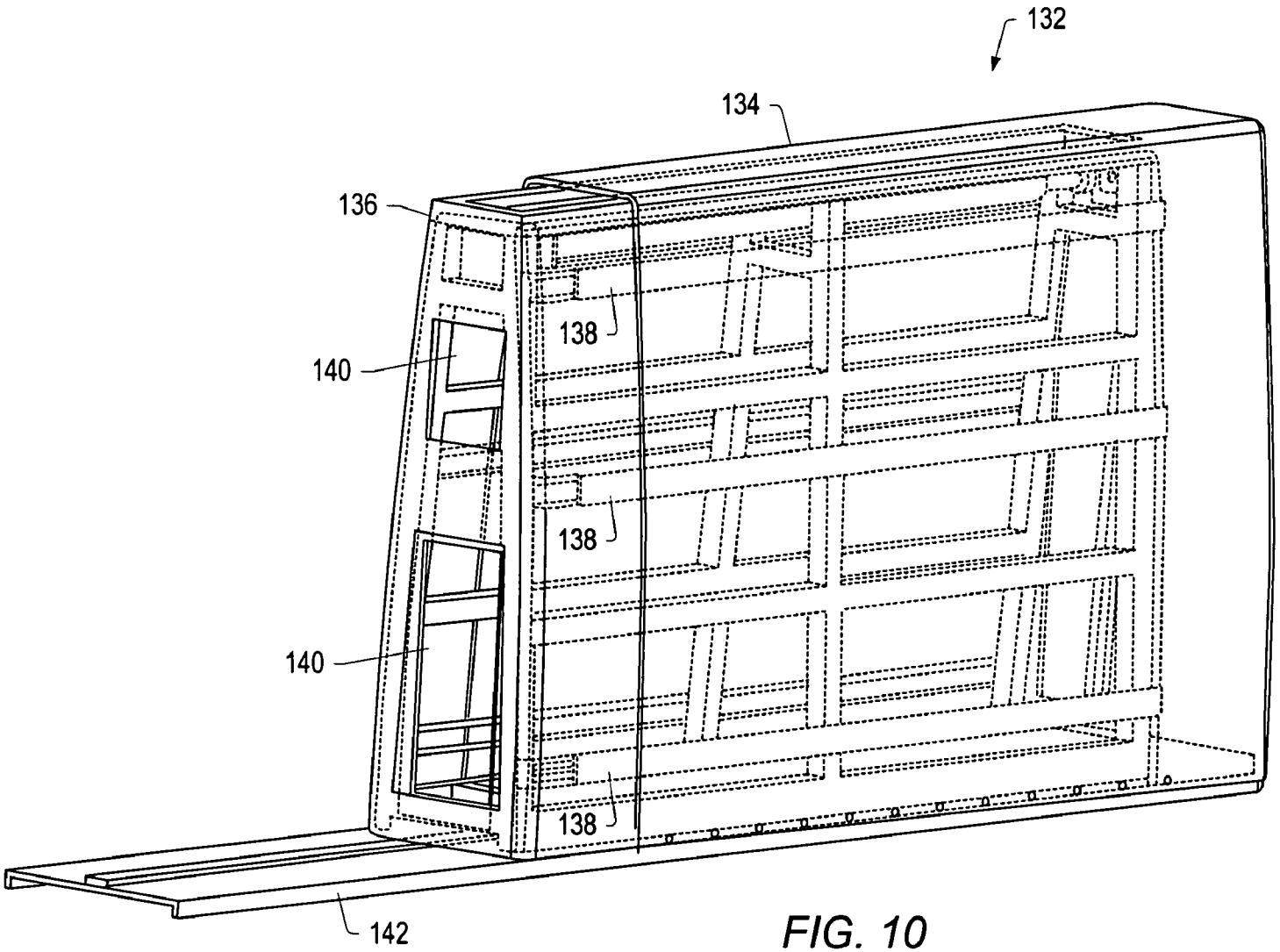
FIG. 10 depicts an embodiment of a gate.

FIGS. 9 and 10 depict embodiments of side gate 132. Side gate 132 includes outer casing 134 and inner casing 136. Inner casing 136 may slide back and forth within outer casing 134. Guides 138 may guide movement of inner casing 136 within outer casing 134. Guides 138 may be, for example, protrusions or strips that slide within grooves on the inner wall of outer casing 134. Inner casing 136 may include one or more access hatches 140. Access hatches 140 may allow for access to internal portions of inner casing 136. Access to internal portions of inner casing 136 may be needed for maintenance and/or repair of side gate 132. Side gate 132 may include base plate 142. Base plate 142 may be used to couple or attach side gate 132 to the walls of a water channel. Side gate 132 may be cast into the concrete of a water channel to affix the gate into the water channel.

Figure 11:
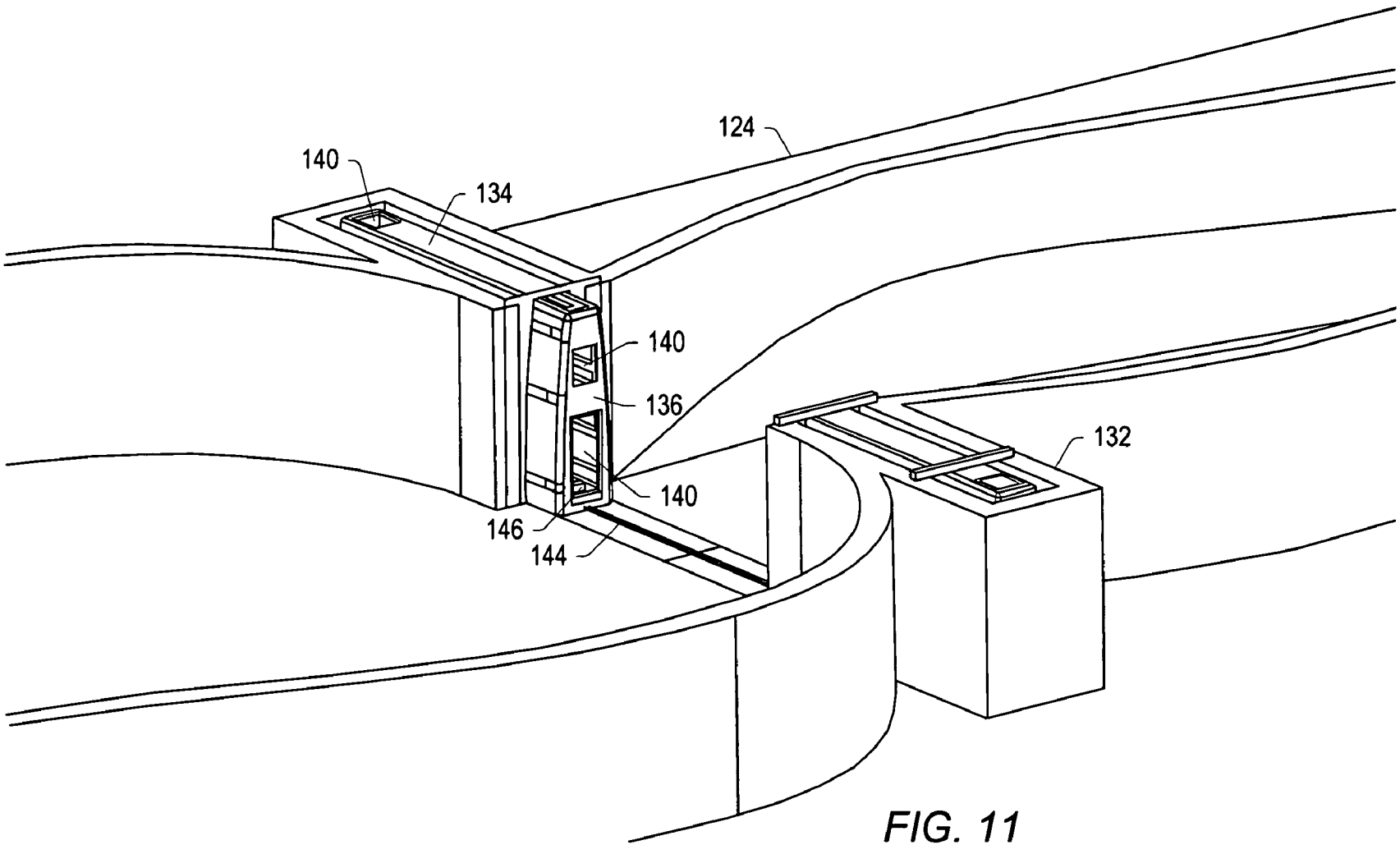
FIG. 11 depicts an embodiment of a gate in a water channel.
Figure 12:
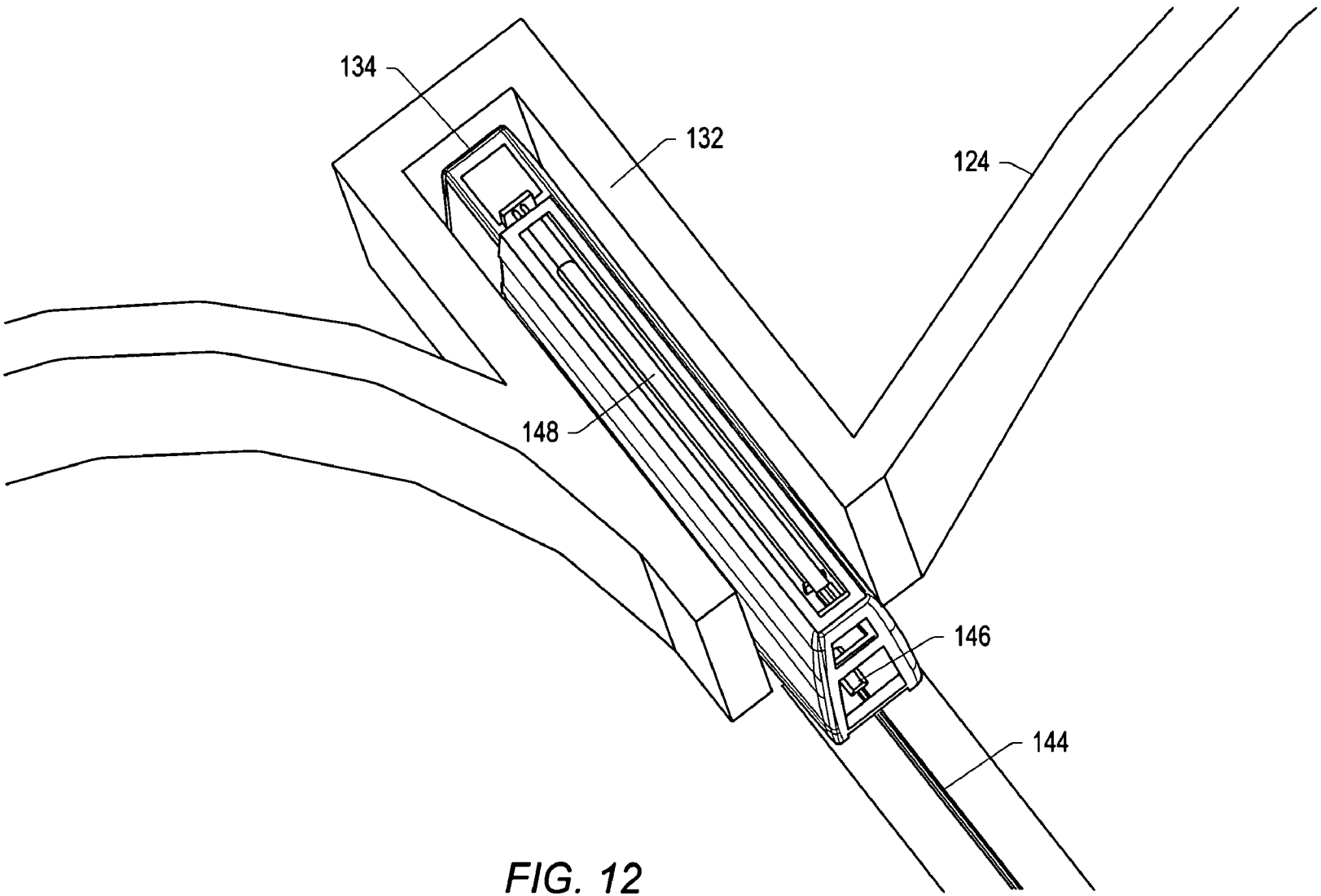
FIG. 12 depicts an embodiment of a gate in a water channel.

FIGS. 11 and 12 depict an embodiment of side gate 132 in water channel 124. Inner casing 136 may move back and forth in water channel 124 along track 144 to open or close side gate 132. Track 144 may be a groove that guides movement of inner casing 136 back and forth. Inner casing 136 may include track car 146 to follow track 144. Track car 146 may remain in track 144 during movement of inner casing 136. Movement back and forth of inner casing 136 opens and closes water flow in water channel 124. Side gate 132 may include piston 148. Piston 148 may be used to move inner casing 136 back and forth to open or close side gate 132. In some embodiments, piston 148 is a hydraulic piston. A portion of side gate 132 may be slurried or cemented into the wall of water channel 124 to affix the gate into place in the water channel. For example, portions of outer casing 134 may be slurried or cemented into place in the wall of water channel 124.

In FIGS. 7-12, side gate 132 is depicted as a side opening gate that opens and closes mechanically into water channel 124. Such side opening gates have moving parts that protrude into the water channel and may come into contact with participants and/or ride operators. In certain embodiments, it may be safer and more preferable to control the flow of water in a water channel without the use of moving parts that can contact participants and/or ride operators. Eliminating contact with moving parts may be particularly needed in water amusement rides with high water velocities and/or gates that operate dynamically to adjust the flow of water in a water channel.

Figure 13:
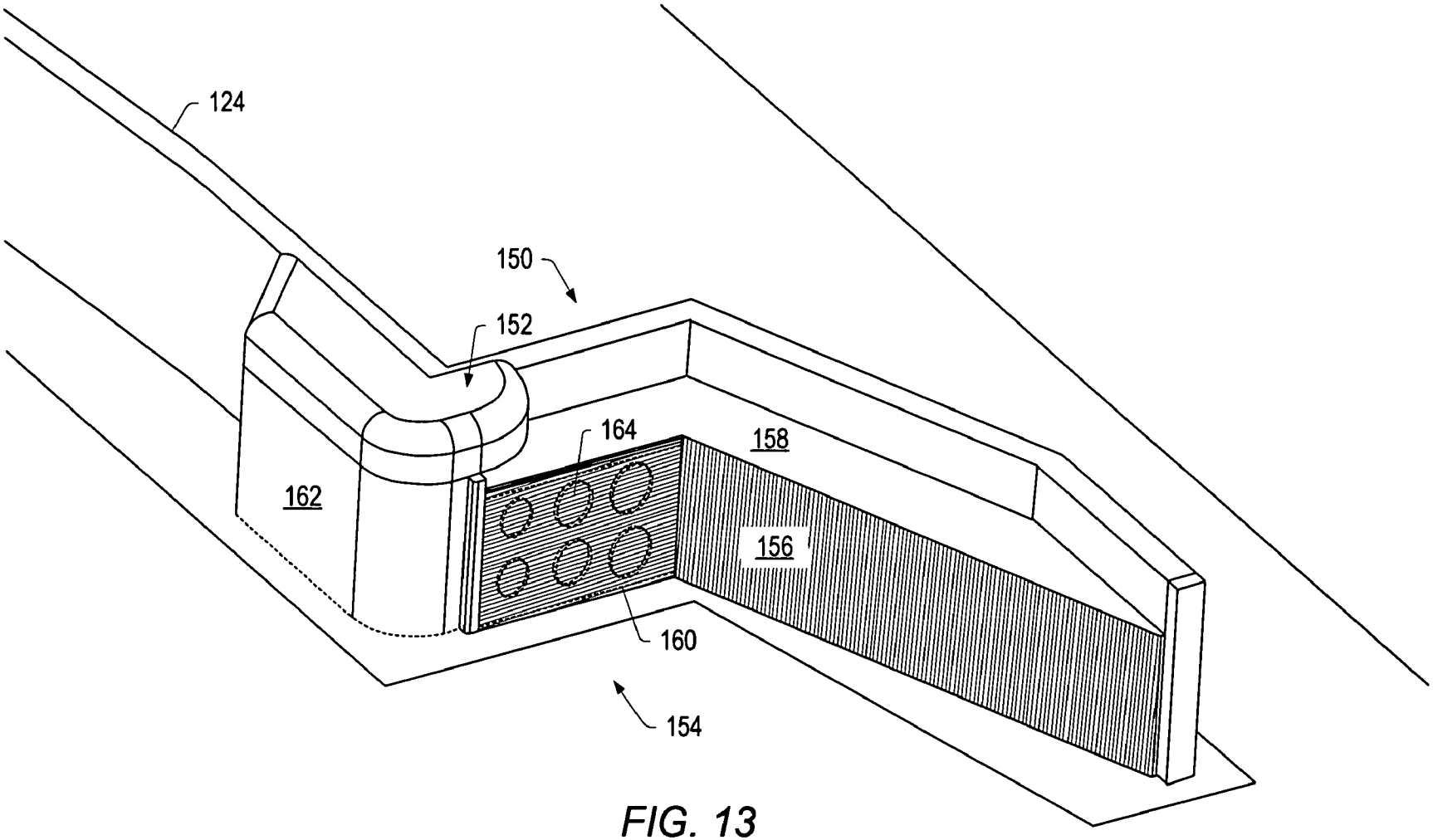
FIG. 13 depicts an embodiment of a gate that has no moving parts that are exposed to ride operators and/or participants in a water channel.

FIG. 13 depicts an embodiment of an adjustable flow controller (e.g., jet gate 150) that has no moving parts exposed to ride operators and/or participants in water channel 124. Jet gate 150 includes adjustable bypass channel 152 into which a portion of water flowing in water channel 124 is diverted. Adjustable bypass channel 152 may be located on one or both sides of water channel 124. Adjustable bypass channel 152 may be located at a junction of a slow moving water section and a fast moving water section.

In some embodiments, a water ride may include a channel. The channel may function to convey participants and/or participant vehicles through a portion of the water ride. The channel may include a first channel section and a second channel section. A channel may include a restriction positioned between the first and second channel sections. The restriction may be downstream of the first channel section. The restriction may function to provide a water effect in and/or downstream of the restriction. Water effects may include, but are not limited to, rapids, waves, fluid jets, and/or whirlpools. The adjustable bypass channel may function to control (e.g., enhance) the water effect.

Adjustable bypass channel 152 may have water entrance 154. Water entrance 154 allows water to enter adjustable bypass channel 152. Water entrance 154 may be coupled to a first channel section. Grates 156 may be located at water entrance 154. Grates 156 may inhibit humans and/or debris from entering adjustable bypass channel 152 while allowing water to flow through the grates and into the adjustable bypass channel. In certain embodiments, grates 156 have 50% or greater transmission area (open flow area versus overall area). Upper surface 158 of water entrance 154 may be solid so that water flows through grates 156 only. Grates 156 may have a height such that upper surface 158 remains above the water line during operation of water channel 124.

Grates 156 may be coupled to water entrance 154 using angles (e.g., stainless steel angles) with bolts or other fasteners suitable for operation in an aqueous environment. Grates 156 may also be coupled to the floor of water channel 124 using, for example, angles or other fasteners. Upper surface 158 of water entrance 154 may include solid materials such as, but not limited to, glass, foam, sheet metal, plastic, or wood. Upper surface 158 may be coupled to the walls of water channel 124 with, for example, angle irons so that personnel may stand on the upper surface during operation of the water ride. A rounded (non-sharp) joint may also be made between upper surface 158 and grates 156 so that no sharp edges exist at the joint of the upper surface and the grates.

One or more baffles 160 may be positioned in water entrance 154 behind grates 156. In some embodiments, baffles 160 may be formed as part of water entrance 154 or main bypass body 162. In certain embodiments, baffle 160 may include one or more separate pieces coupled to main bypass body 162. Baffle 160 may include one or more openings 164 of various sizes and/or shapes. The size of openings 164 may be adjusted to control the velocity and/or amount of water entering adjustable bypass channel 152. In certain embodiments, the velocity of water entering adjustable bypass channel 152 is maintained below a selected value (e.g., a value selected to be within specified code requirements for the water amusement ride) or within a range of values. Baffle 160 and openings 164 may be used to substantially equalize flow in water entrance 154. Water velocity entering water entrance 154 may be unbalanced because of water entering at different distances from main bypass body 162. The size, number, and/or location of openings 164 on baffle 160 may be adjusted to substantially equalize the flow of water into main bypass body 162. The size, number, and/or location of openings 164 may be determined through mathematical calculations and/or field testing of baffle 160.

Adjustable bypass channel 152 may include a restriction (e.g., a valve) that controls the flow of water through the adjustable bypass channel to control the amount of water exiting the adjustable bypass channel. In some embodiments, water exiting the adjustable bypass channel may exit into the second channel section. Water exiting adjustable bypass channel 152 may be at a higher velocity than water entering the adjustable bypass channel so that the velocity of water exiting the adjustable bypass channel more closely matches the velocity of water in a fast moving water section downstream of the adjustable bypass channel. Adjustable bypass channel 152 may be used in a similar manner to a side gate to restrict and control the flow of water through water channel 124 to control the water level in a slow moving water section upstream of the gate and/or control the hydraulic profile of water in a fast moving water section downstream of the gate.

The external parts of adjustable bypass channel 152 may contribute to a theme for a water amusement ride. For example, the external parts may represent a rock theme. One or more external edges of adjustable bypass channel 152 may be rounded so that the adjustable bypass channel has no sharp edges. The external covers of adjustable bypass channel 152 may be internally flanged to provide rigidity and joining surfaces for the parts.

FIGS. 14-18 depict embodiments of internal portions of adjustable bypass channel 152. The internal portions of adjustable bypass channel 152 depicted in FIGS. 14-18 may be located within a structure that inhibits participants from coming into contact with the internal portions and/or inhibits operators of the water ride from accessing the internal portions during operation of the water ride. Adjustable bypass channel 152 may include one or more access panels that may be removed during non-operating times of the water ride. These access panels may be removed by certified personnel (e.g., ride operators and/or ride mechanics) when it is safe to access the internal portions of adjustable bypass channel 152 (e.g., during shutdown periods of the water ride). Certain internal portions of adjustable bypass channel 152 may include one or more safety grates. Safety grates may include bar grates or other access inhibitors that allow water flow but inhibit human access during operation of adjustable bypass channel 152. These safety grates may be located away from any operating parts within adjustable bypass channel 152 to inhibit human access to the operating parts during operation.

Figure 14:
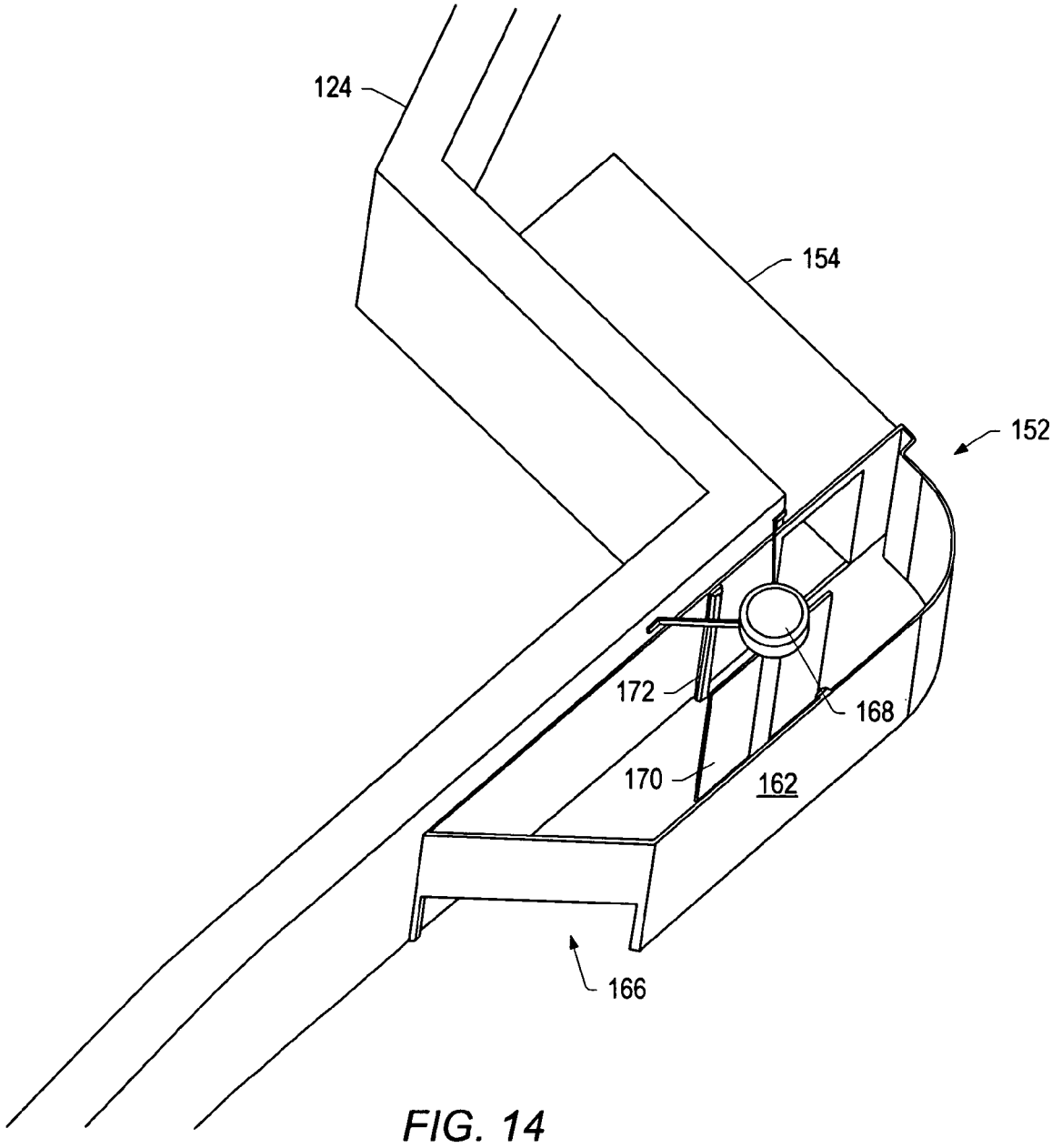
FIG. 14 depicts a perspective representation of an embodiment of the internal portions of an adjustable bypass channel.
Figure 18:
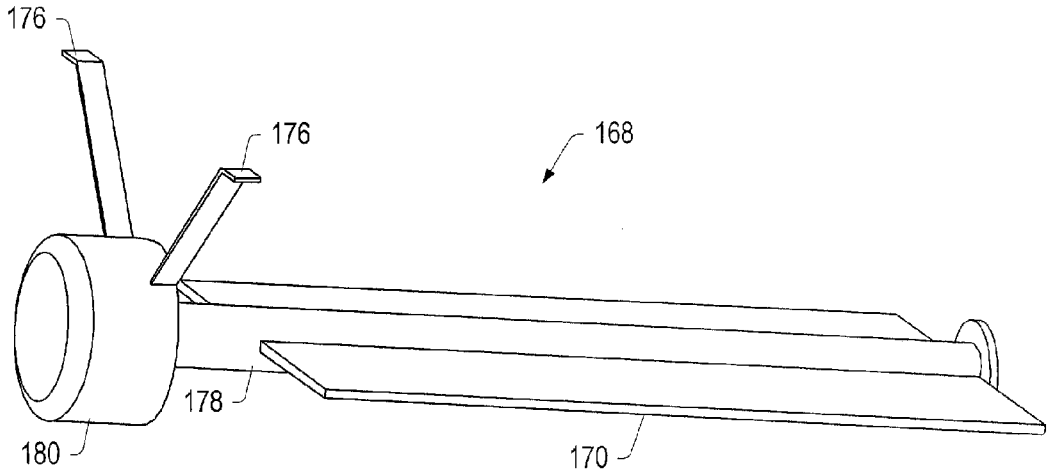
FIG. 18 depicts an embodiment of a valve.

FIG. 14 depicts a perspective representation of an embodiment of internal portions of adjustable bypass channel 152. Adjustable bypass channel 152 includes water entrance 154 and water exit 166. Water enters adjustable bypass channel 152 through water entrance 154. Water exits adjustable bypass channel 152 through water exit 166. Water entrance 154 may be in fluid communication with a slow moving water section of water channel 124. Water may flow through water entrance 154 into main bypass body 162. Valve 168 may be located in main bypass body 162. Valve 168 may control the flow of water through adjustable bypass channel 152. Valve 168 may be an adjustable valve. In certain embodiments, valve 168 is an adjustable butterfly valve, as shown in FIG. 18. Valve 168 may be used to control the amount of water flowing out of adjustable bypass channel 152. Blades 170 of valve 168 may close against stops 172 to inhibit water flow through adjustable bypass channel 152. Stops 172 may be coupled to or be formed as part of main bypass body 162. In certain embodiments, stops may also be located on the bottom of main bypass body 162 to seal against blades 170 of valve 168 and further inhibit flow when the valve is closed. Water exit 166 may be in fluid communication with a fast moving water section of water channel 124.

In certain embodiments, one or more spacers, pads, or other protrusions may be coupled to the outside of main bypass body 162. These spacers or pads may be added to main bypass body 162 to adjust the width of the channel of water flowing past adjustable bypass channel 152. The spacers or pads may be rounded, flat, or other shapes. The spacers or pads may be made of material that is water resistant and may reduce impact forces on objects (e.g., participants or floatation devices) that may contact the spacers or pads. The spacers or pads may be coupled to main bypass body 162 by screws, bolts, or other fasteners. The number, width, or size of the spacers or pads may be adjusted by personnel associated with operation of water channel 124 to adjust the width of the water channel at adjustable bypass channel 152.

Figure 15:
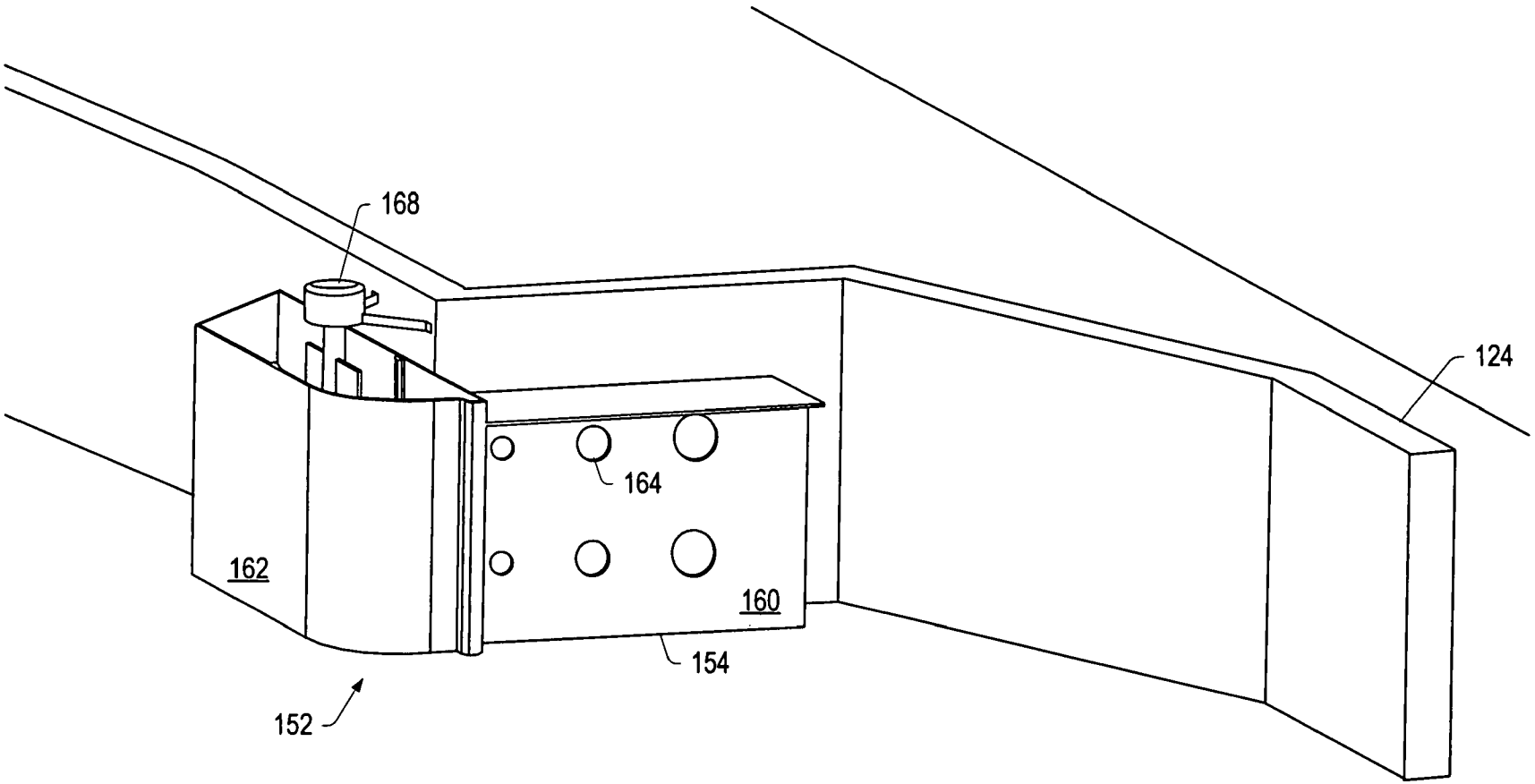
FIG. 15 depicts a perspective representation of an embodiment of the internal portions of an adjustable bypass channel showing a water entrance.

FIG. 15 depicts a perspective representation of an embodiment of the internal portions of adjustable bypass channel 152 showing water entrance 154. The size of water entrance 154 may be adjusted to adjust the amount of water diverted into adjustable bypass channel 152. For example, water entrance 154 may be sized to divert about 25% of the water in water channel 124 into adjustable bypass channel 152. The amount of water diverted into adjustable bypass channel 152 may be adjusted to accommodate, for example, variable flow rates in water channel 124, varying widths of the water channel, or varying water depths of the water channel.

Figure 16:
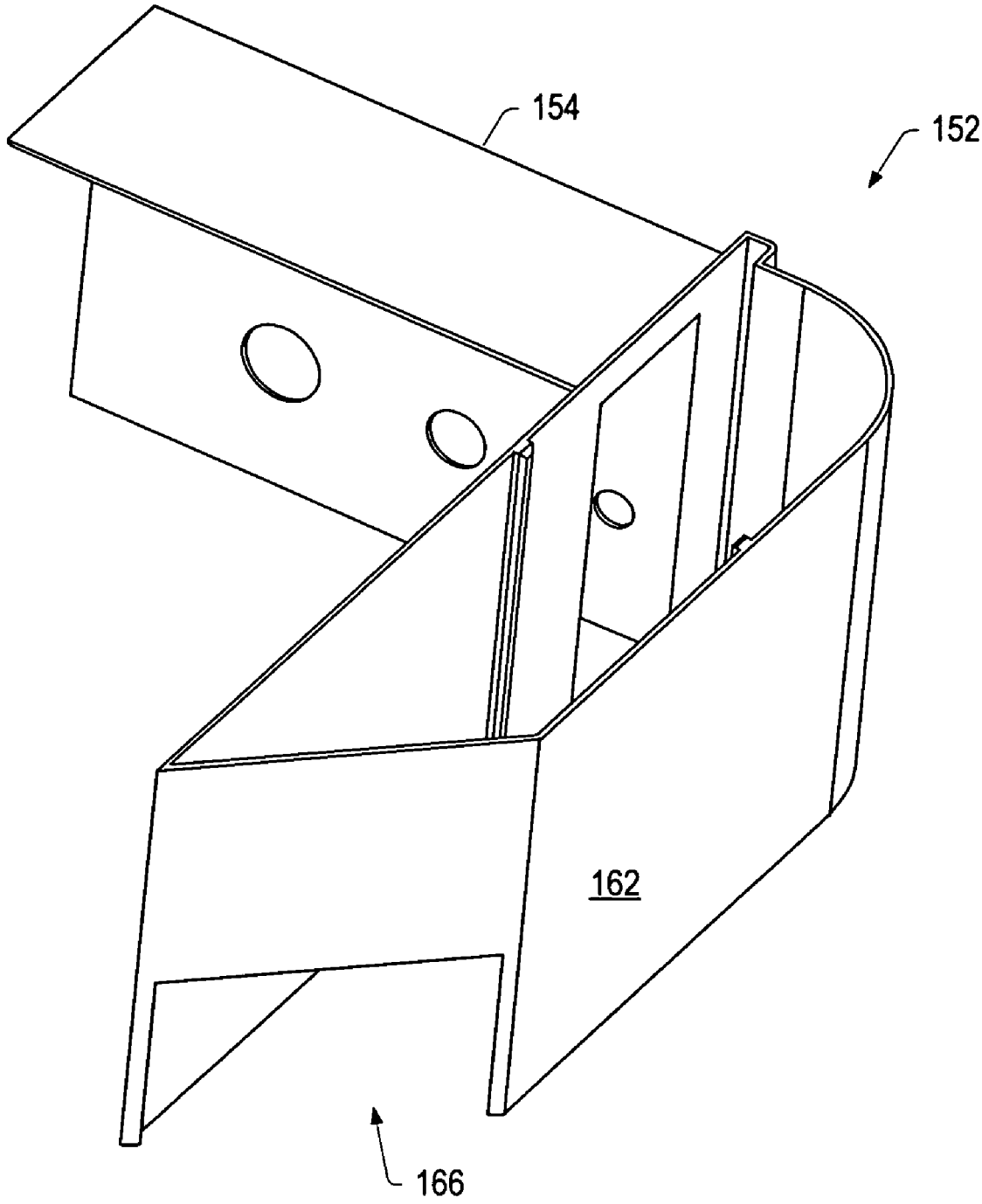
FIG. 16 depicts a rear view of an embodiment of the internal portions of an adjustable bypass channel showing a water exit.

FIG. 16 depicts a perspective representation of an embodiment of the internal portions of adjustable bypass channel 152 showing water exit 166. Water exit 166 may be formed as a portion of main bypass body 162. Water exit 166 may be sized to control the flow of water out of adjustable bypass channel 152. The size of water exit 166 along with the head of water upstream of adjustable bypass channel 152 controls the flow through the exit of the adjustable bypass channel. In certain embodiments, water exit 166 is sized to allow a selected value of full flow for a maximum value of head of water upstream of adjustable bypass channel 152. In some embodiments, one or more inserts may be coupled to water exit 166 to adjust the size of the opening. For example, inserts may be coupled to water exit 166 during shutdown times of the water ride.

In certain embodiments, a baffle may be coupled to an upper lip of water exit 166 and extend into main bypass body 162 at an upwardly sloping angle (e.g., an upward angle of about 45°). The baffle may produce a smoother flow of water through water exit 166. The baffle may also inhibit human entrapment above the baffle. A safety grate may be coupled to the baffle to inhibit human access during operation of adjustable bypass channel 152.

Figure 17:
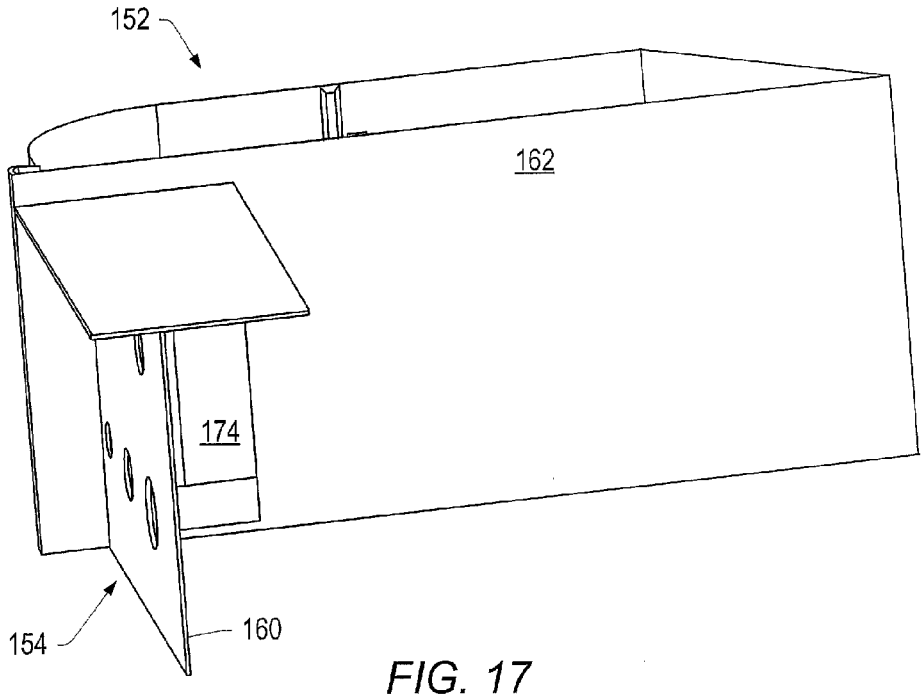
FIG. 17 depicts a side view of an embodiment of the internal portions of an adjustable bypass channel showing a water entrance and an internal opening.

Other openings within main bypass body 162 may be sized (e.g., made as large as possible) so that the other openings provide little or no effect on the exit flow of water from adjustable bypass channel 152. FIG. 17 depicts a side view of an embodiment of the internal portions of adjustable bypass channel 152 showing water entrance 154 and internal opening 174. Internal opening 174 allows water from water entrance 154 to enter main bypass body 162. Internal opening 174 may have a size that provides little or no resistance to water flow in adjustable bypass channel 152.

FIG. 18 depicts an embodiment of valve 168. Valve 168 may include brackets 176. Brackets 176 may be used to couple valve 168 to a wall of water channel 124. Valve 168 may have body 178 and actuator 180. Brackets 176 may be coupled to actuator 180. Actuator 180 may remain above the water line in adjustable bypass channel 152. Actuator 180 may be an electrically operated actuator or a manually (mechanically) operated actuator. Operating parts of actuator 180 may be enclosed in a watertight box. Body 178 may include blades 170. Blades 170 may be sized so that at least some portion of the blades remain above the water line for varying depths of water caused by opening and/or closing of valve 168. Blades 170 may be rotatable over 90° using actuator 180. The 90° of rotation allows blades 170 to be set at angles between fully open (full flow through adjustable bypass channel 152) or closing flow off by contacting the blades against stops 172 of main bypass body 162 (shown in FIG. 14). Stops 172 may be made of flexible and strong sealing material that inhibits 95% or more flow of water when blades 170 contact the stops. The material of stops 172 may also inhibit banging or bouncing when blades 170 contact the stops.

Water exiting adjustable bypass channel 152 is at a higher velocity than water entering the adjustable bypass channel. Adjustment of valve 168 controls the amount of water exiting adjustable bypass channel 152. Thus, the total water flow from upstream of adjustable bypass channel 152 to downstream of the adjustable bypass channel is controlled. Adjustment of valve 168 also controls the head (level) of water upstream of adjustable bypass channel 152. In some embodiments, valve 168 may be the only moving part of adjustable bypass channel 152. Valve 168 is shielded from contact by participants and/or other human access during operation of adjustable bypass channel 152. Adjustable bypass channel 152 provides an effective way of controlling water flow in water channel 124 while substantially removing the risk of contacting participants with moving parts in the water channel.

In certain embodiments, valve 168 may be operated to vary the size and/or shape of waves downstream of adjustable bypass channel 152. Valve 168 may be operated to create hydraulic effects such as flash floods, river waves, or other dynamic water effects. In some embodiments, valve 168 may be alternately closed and opened to store and release water and send surges of water downstream from adjustable bypass channel 152 to achieve various hydraulic effects. Actuator 180 of valve 168 may have controls and power sufficient to open and close the valve quickly during operation to produce surges of water.

Figure 19:
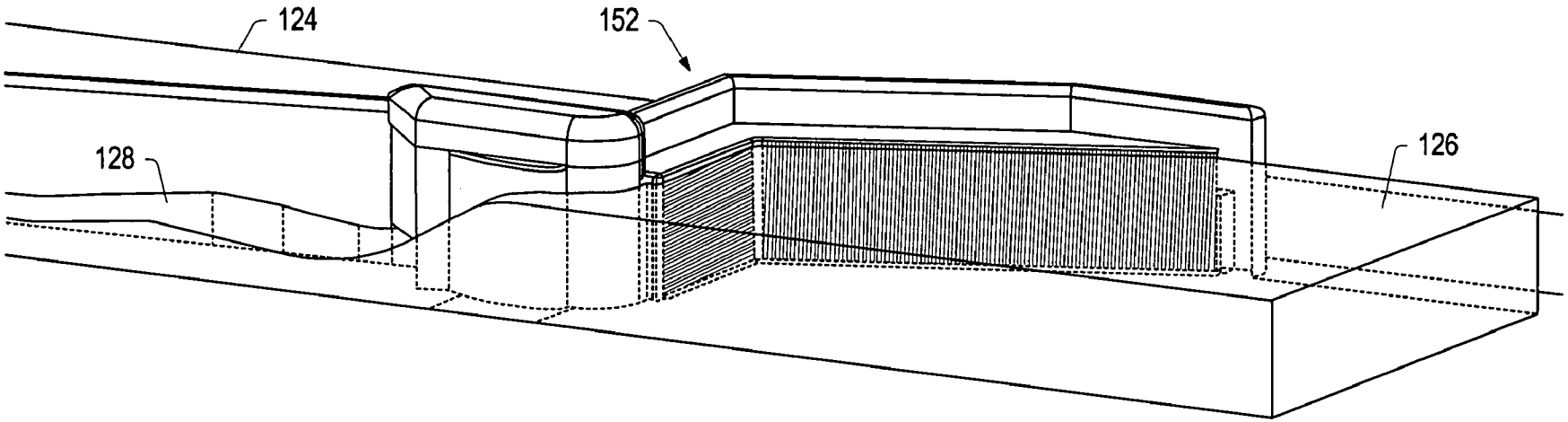
FIG. 19 depicts a perspective view of an embodiment of an adjustable bypass channel with water in a water channel.
Figure 20:
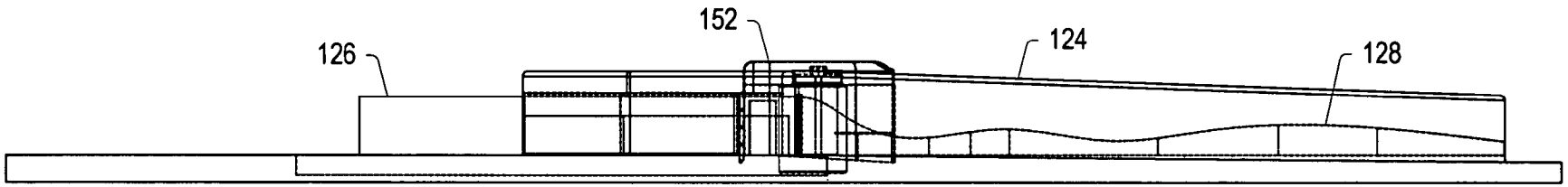
FIG. 20 depicts a side view of an embodiment of an adjustable bypass channel with water in a water channel.
Figure 21:
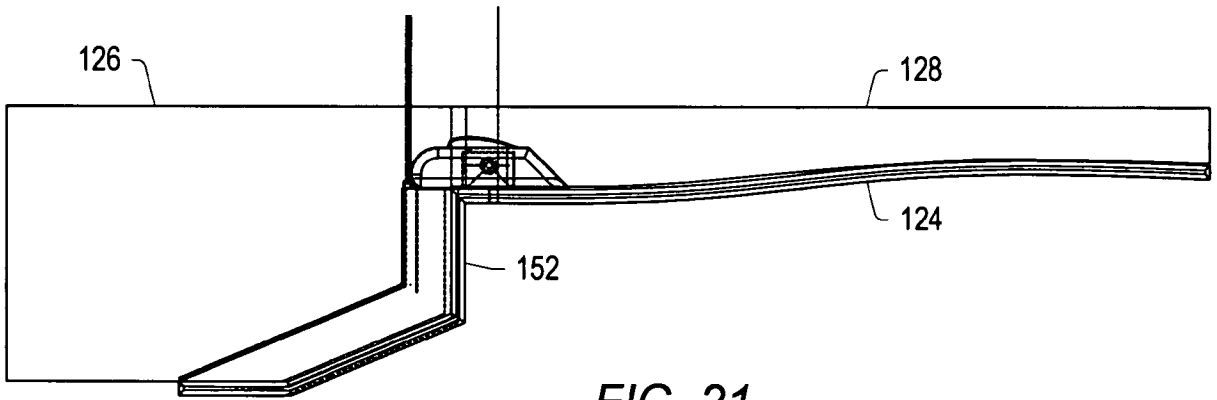
FIG. 21 depicts a top view of an embodiment of an adjustable bypass channel with water in a water channel.

FIG. 19 depicts a perspective view of an embodiment of adjustable bypass channel 152 with water in water channel 124. FIG. 20 depicts a side view of an embodiment of adjustable bypass channel 152 with water in water channel 124. FIG. 21 depicts a top view of an embodiment of adjustable bypass channel 152 with water in water channel 124. Adjustable bypass channel 152 may be located at a junction of slow moving water section 126 and fast moving water section 128. Water may have a selected depth in slow moving water section 126 that is controlled by adjustable bypass channel 152. Slow moving water section 126 is typically flat and horizontal. Fast moving water section 128 may slope downward from slow moving water section 126. In some embodiments, fast moving water section 128 slopes downward at about 3.5° from flat, horizontal slow moving water section 126. The exit section of adjustable bypass channel 152 may be angled downward to accommodate (e.g., approximately conform to) the slope of fast moving water section 128. The slope may begin at a section of water channel 124 where the wall turns 90° at adjustable bypass channel 152.

Figure 22:
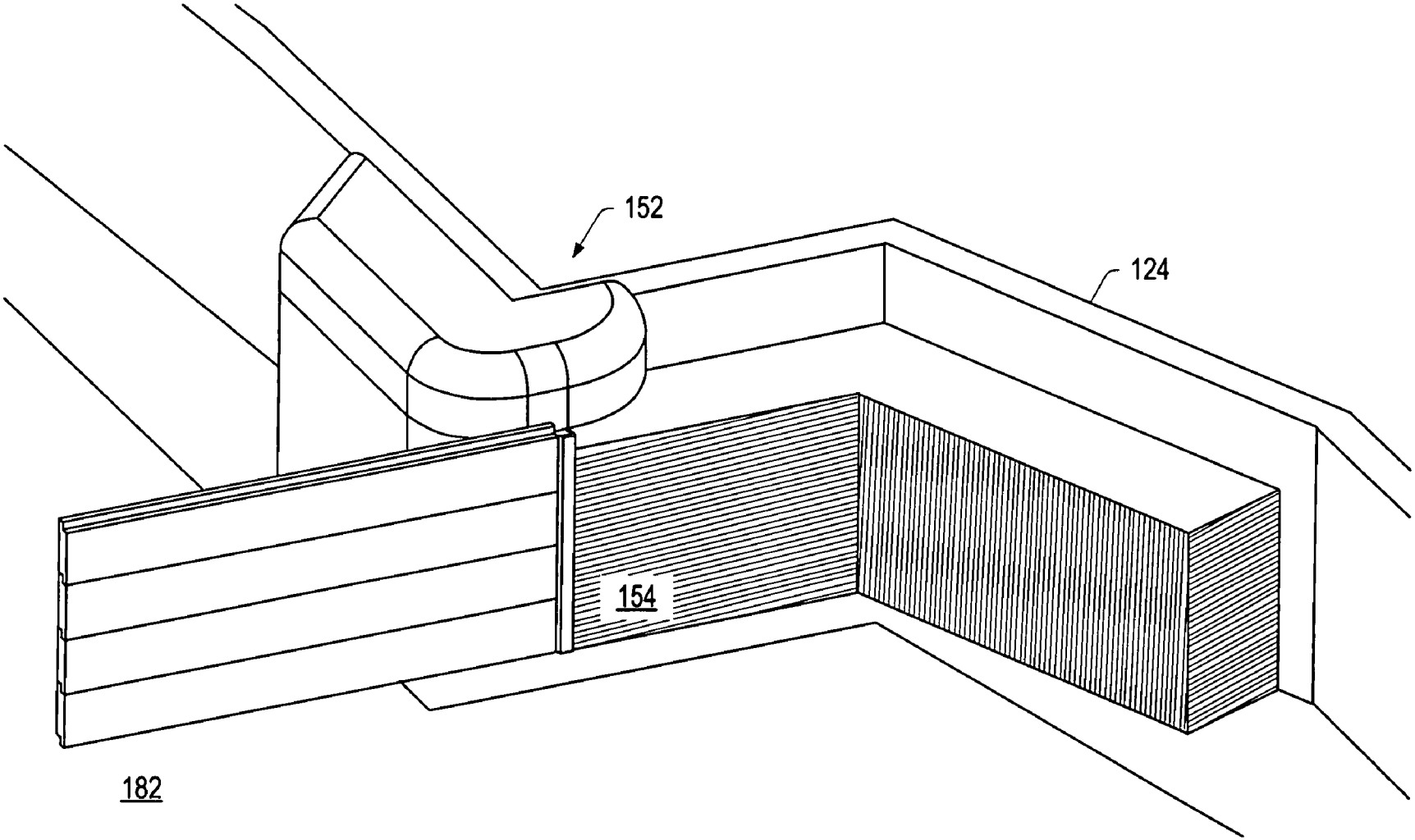
FIG. 22 depicts an embodiment of a dam coupled to an adjustable bypass channel.

In certain embodiments, inserts (e.g., stops or dam logs) may be coupled to adjustable bypass channel 152 to dam off water flow in water channel 124. FIG. 22 depicts an embodiment of a dam coupled to adjustable bypass channel 152. Dam 182 may be coupled to adjustable bypass channel 152. Dam 182 may include one or more inserts that are coupled to adjustable bypass channel 152.

Figure 23:
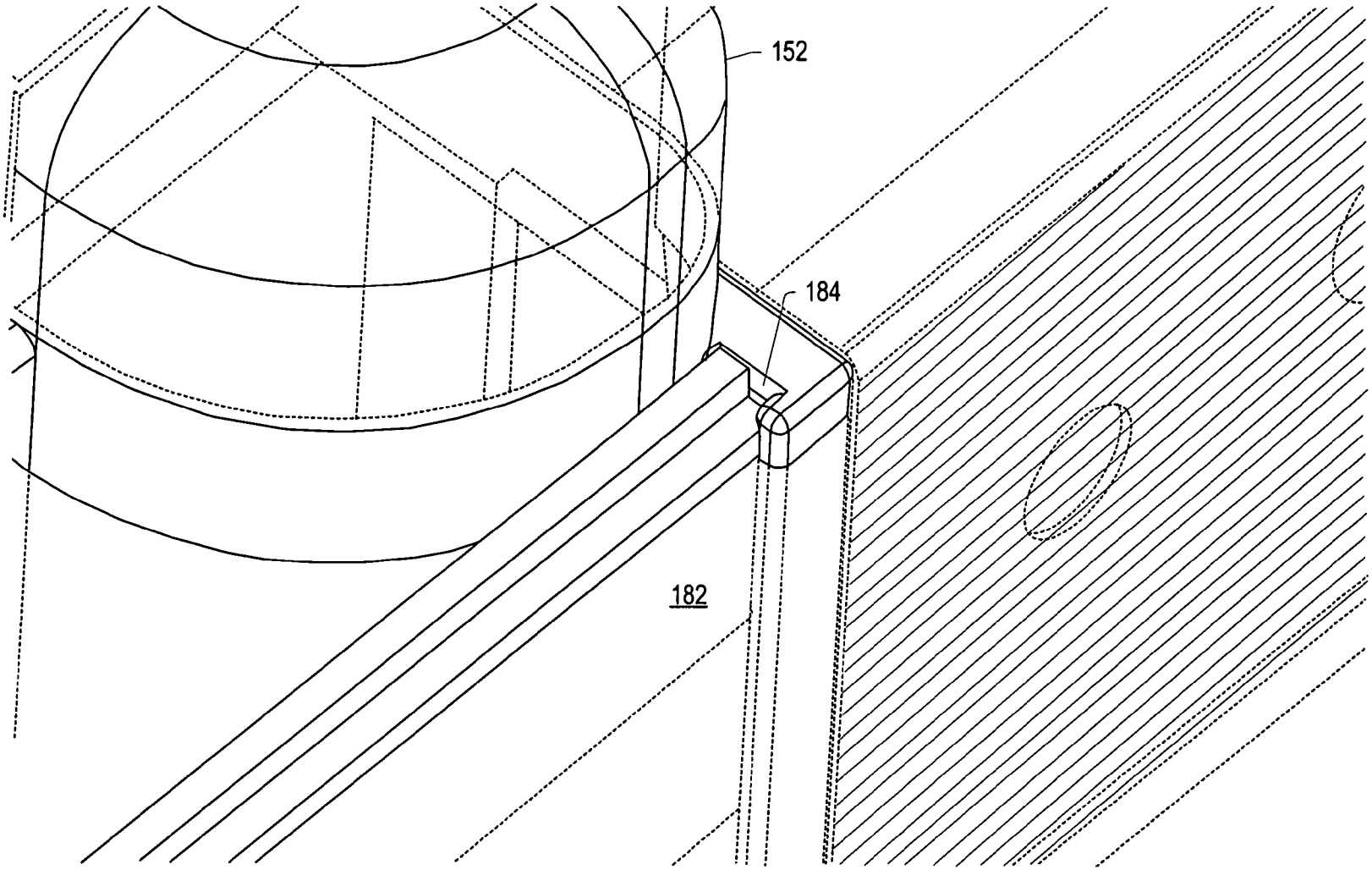
FIG. 23 depicts an enlarged view of a coupling between a dam and an adjustable bypass channel.

FIG. 23 depicts an enlarged view of a coupling between dam 182 and adjustable bypass channel 152. Dam 182 may include inserts that are inserted into groove 184 on adjustable bypass channel 152, as shown in FIG. 23. Dam 182 may be used to close off water flow in water channel 124 during shutdown periods or off hours of operation of the water channel. Dam 182 inhibits water flow to lower elevations of water channel 124 as described herein. Dam 182 may not close off 100% of the flow of water as some water may be allowed to flow past the dam (e.g., filtration water may flow during shutdown and flow through the water channel).

Inserts used in dam 182 may be made of slightly negatively buoyant material. Wood is typically not used externally for the inserts due to sanitary reasons in water channel 124. If the inserts are buoyant, the inserts may be locked down. For example, the inserts may interlock to each other horizontally, to adjustable bypass channel 152, and/or to the floor of water channel 124.

In some embodiments, adjustable bypass channel 152 is used to restrict the flow of water in a water channel so that water may be selectively routed to another water channel through a connecting channel without changing elevation of the water between channels. An adjustable bypass channel may be used to restrict the flow of water and divert the water without using mechanical means of moving water and/or guests between the rivers (e.g., conveyors).

In some embodiments, a water ride may include a first channel of water which functions to convey participants in a first direction. A water ride may include a first adjustable flow controller positioned in the first channel of water. A water ride may include a second channel of water which functions to convey participants in a second direction different from the first direction. In certain embodiments, the second direction may be substantially opposite the first direction. A water ride may include a third channel coupling the first channel, upstream of the first adjustable flow controller, to the second channel. The first adjustable flow controller may function to control the flow of water through the third channel.

In some embodiments, a water ride may include a second adjustable flow controller positioned in the second channel of water. The third channel couples to the second channel downstream of the second adjustable flow controller. The water ride may include a fourth channel coupling the second channel, upstream of the second adjustable flow controller, to the first channel, downstream of the first adjustable flow controller. The second adjustable flow controller is configured to control the flow of water through the fourth channel.

Figure 24:
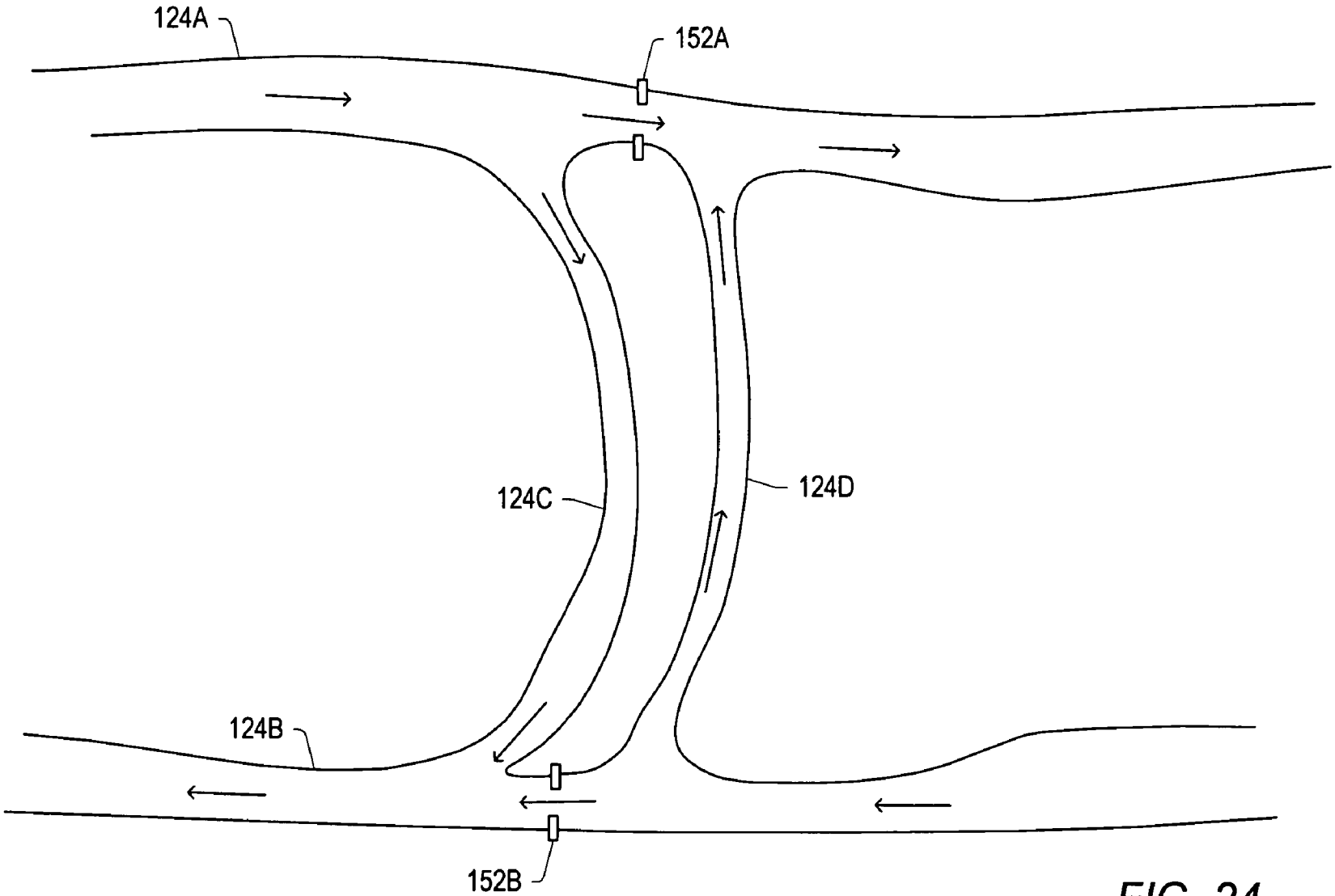
FIG. 24 depicts a representation of an embodiment for coupling two channels of water using connecting channels and adjustable bypass channels.

FIG. 24 depicts a representation of an embodiment for coupling two channels of water using connecting channels and adjustable flow controllers (e.g., adjustable bypass channels). First channel of water 124A is coupled to second channel 124B with third and fourth channels 124C and 124D. Participants may move between channels 124A, 124B using channels 124C, 124D. In certain embodiments, participants may move from first channel 124A to second channel 124B using third channel 124C. Participants may move from second channel 124B to first channel 124A using fourth channel 124D.

First adjustable flow controller 152A may be used to control the flow of water in first channel 124A. Second adjustable flow controller 152B may be used to control the flow of water in second channel 124B. A portion of water in first channel 124A may be diverted to third channel 124C. Similarly, a portion of water in second channel 124B may be diverted to fourth channel 124D. In certain embodiments, water is diverted upstream of adjustable flow controllers 152A, 152B. Adjustable flow controllers 152A, 152B may be used to control the amount of water diverted into channels 124C, 124D. The amount of water diverted to channels 124C, 124D and/or the amount of water flowing downstream of the adjustable flow controller may be adjusted by controlling the flow of water using adjustable flow controllers 152A, 152B.

Adjustable flow controllers 152A, 152B may be used to control the depths of water both downstream and upstream of the adjustable flow controllers. In certain embodiments, water upstream of adjustable flow controllers 152A, 152B is at a higher elevation than water downstream of the adjustable flow controllers. The sections of channels 124A, 124B downstream of adjustable flow controllers 152A, 152B may be at a substantially similar elevation. Similarly, the sections of water channels 124A, 124B upstream of adjustable flow controllers 152A, 152B may be at a substantially similar elevation. In some embodiments, the downstream and/or upstream sections of channels 124A, 124B are at different elevations. Adjustable flow controllers 152A, 152B may be used to control the flow of water in channels 124A, 124B and channels 124C, 124D to maintain water depths in the water channels so that water flow is substantially equalized between the water channels. Substantially equalizing the flow between channels 124A, 124B allows water to flow openly between the channels of water (e.g., channels 124A, 124B and channels 124C, 124D). Thus, an interconnecting open channel flow system is created between second channel 124A and first channel 124B using channels 124C, 124D.

In some embodiments, a first channel of water may include a first portion at a higher elevation, a second portion at a lower elevation, and a first adjustable flow controller positioned between the first and second portions. A second channel of water may include a third portion at a higher elevation, a fourth portion at a lower elevation, and a second adjustable flow controller positioned between the third and fourth portions. A fourth channel may couple the third portion of the second channel, upstream of the second adjustable flow controller, to the second portion of the first channel, downstream of the first adjustable flow controller. A third channel may couple the first portion of the first channel, upstream of the first adjustable flow controller, to the fourth portion of the second channel, downstream of the second adjustable flow controller.

In some embodiments, controlling the flow of water through the fourth channel may adjust a participant flow rate through the fourth channel. Controlling the flow of water through the third channel may adjust a participant flow rate through the third channel.

In some embodiments, water in the first channel upstream of the first adjustable flow controller may be at a substantially similar elevation to water in the second channel upstream of the second adjustable flow controller. Water in the first channel downstream of the first adjustable flow controller may be at a substantially similar elevation to water in the second channel downstream of the second adjustable flow controller. Water in the first channel upstream of the first adjustable flow controller may be at a higher elevation than water in the first channel downstream of the first adjustable flow controller. Water in the second channel upstream of the second adjustable flow controller may be at a higher elevation than water in the second channel downstream of the second adjustable flow controller.

In some embodiments, a first adjustable flow controller may function to control the amount of water flowing downstream of the first adjustable flow controller and the amount of water flowing through the third channel. A second adjustable flow controller may function to control the amount of water flowing downstream of the second adjustable flow controller and the amount of water flowing through the fourth channel.

In some embodiments, a water ride comprises a continuous water ride. The water ride may be part of a water amusement system.

An adjustable flow controller may include any device or system of devices which adjust a flow of water through a portion of a body of water (e.g., a channel). In some embodiments, an adjustable flow controller may include, but is not limited to, a positionable gate, weir, positionable weir, an adjustable bypass channel, a jet gate, and/or an adjustable valve.

In some embodiments, a water ride may include an automated control system functioning to control the first and/or second adjustable flow controller.

In certain embodiments, several connecting channels and/or several adjustable bypass channels may be used to interconnect two or more water channels in an open channel flow system. For example, two water channels may be interconnected by four, six, or eight interconnecting channels with adjustable bypass channels located at or near each interconnecting channel to control the flow of water between water channels. In some embodiments, three or more water channels are interconnected using connecting channels. Adjustable bypass channels may be used to control the flow of water in the water channels so that the three or more water channels are interconnected in an open channel flow system.

In this patent, certain U.S. patents, U.S. patent applications, and other materials (e.g., articles) have been incorporated by reference. The text of such U.S. patents, U.S. patent applications, and other materials is, however, only incorporated by reference to the extent that no conflict exists between such text and the other statements and drawings set forth herein. In the event of such conflict, then any such conflicting text in such incorporated by reference U.S. patents, U.S. patent applications, and other materials is specifically not incorporated by reference in this patent.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A water ride, comprising:

a water channel, wherein the water channel comprises:

a first channel section configured to convey participants;

a restriction coupled to the first channel section, wherein the restriction is downstream of the first channel section, and wherein the restriction is configured to provide a water effect in and/or downstream of the restriction; and a second channel section coupled to the restriction, wherein the second channel section is downstream of the restriction;

an adjustable bypass channel coupled to the first channel section and the second channel section, wherein the adjustable bypass channel is configured to convey a controlled portion of water from upstream the restriction to a location downstream of the restriction such that the water effect provided by the restriction is controlled, and wherein the adjustable bypass channel is configured such that participants and/or participant vehicles are inhibited from entering the adjustable bypass channel.

2. The water ride of claim 1, wherein the water effect comprises one or more rapids.

3. The water ride of claim 1, wherein the water effect comprises one or more waves.

4. The water ride of claim 1, wherein the adjustable bypass channel is configured to convey a controlled portion of water from upstream the restriction to a location downstream of the restriction such that an intensity of the water effect provided by the restriction is controlled.

5. The water ride of claim 1, wherein the adjustable bypass channel is configured to convey a controlled portion of water from upstream the restriction to a location downstream of the restriction such that an intensity of the water effect provided by the restriction is controlled, and wherein controlling the intensity of the water effect comprises controlling the flow rate of the water downstream of the restriction.

6. The water ride of claim 1, wherein the adjustable bypass channel is configured to control a hydraulic profile of water in the second channel section.

7. The water ride of claim 1, wherein the adjustable bypass channel comprises an adjustable valve.

8. The water ride of claim 1, wherein the adjustable bypass channel comprises an adjustable valve, and wherein a water exit of the adjustable bypass channel is sized to provide a selected amount of water flow through the adjustable bypass channel when the adjustable valve is fully open to water flow.

9. The water ride of claim 1, wherein the adjustable bypass channel comprises an adjustable valve, and wherein the adjustable valve comprises a butterfly valve.

10. The water ride of claim 1, further comprising a baffle at or near a water entrance of the adjustable bypass channel, wherein the baffle is configured to substantially equalize water flow into the adjustable bypass channel.

11. The water ride of claim 1, further comprising one or more grates configured to inhibit access into the adjustable bypass channel during operation of the adjustable bypass channel.

12. The water ride of claim 1, further comprising a baffle coupled to a water exit of the adjustable bypass channel, wherein the baffle is configured to smooth out water flow through the water exit.

13. The water ride of claim 1, wherein the adjustable bypass channel comprises an adjustable valve, and wherein the adjustable valve is configured to be dynamically adjusted to create various sizes and/or shapes of water flow in the second channel section.

14. The water ride of claim 1, further comprising one or more inserts configured to be coupled to the adjustable bypass channel, wherein the inserts are configured to substantially stop water flow through the second channel section.

15. The water ride of claim 1, wherein a portion of the second channel section comprises a greater slope relative to a portion of the first channel section.

16. The water ride of claim 1, wherein a portion of the adjustable bypass channel is sloped to approximately conform to the sloped portion of the second channel section.

17. The water ride of claim 1, wherein a portion of the first channel section comprises a slow moving water portion, and wherein a portion of the second channel section comprises a fast moving water portion.

18. The water ride of claim 1, further comprising an automated control system configured to control the adjustable bypass channel.

19. A method for controlling a flow of water in a channel in a water amusement park, comprising:

diverting at least a portion of the flow of water from a first channel section in a water channel of a water amusement ride into an adjustable bypass channel;

inhibiting participants being conveyed through the water channel of the water amusement ride from accessing the adjustable bypass channel;

providing a water effect using a restriction to produce the water effect coupled to the first channel section and positioned downstream of the first channel section; and controlling the amount of water that exits the adjustable bypass channel into a second channel section, coupled to the restriction and positioned downstream of the restriction, to control the amount of water flowing in the water channel downstream of a restriction such that an intensity of the water effect provided by the restriction is controlled.

20. The method of claim 19, further comprising dynamically adjusting the amount of water that exits the bypass channel to create various sizes and/or shapes of water flow downstream of the bypass channel.

21. The method of claim 19, wherein the first channel section of the water channel upstream of the water bypass channel comprises a relatively flat portion, and wherein the second channel section of the water channel downstream of the water bypass channel comprises a sloped portion.

22. The method of claim 19, further comprising equalizing water flow into the bypass channel using one or more baffles.

23. The method of claim 19, further comprising smoothing out water flow exiting the bypass channel using one or more baffles.

* * * * *